US012172804B2

(12) United States Patent
Hawes et al.

(10) Patent No.: US 12,172,804 B2
(45) **Date of Patent: *Dec. 24, 2024**

(54) CONTAINER ASSEMBLY

(71) Applicant: CALIFORNIA INNOVATIONS INC., Toronto (CA)

(72) Inventors: Tommy Hawes, Toronto (CA); Kenneth Bertoli, Canton, GA (US); Richard C. Stephens, Chicago, IL (US); Brandon Lee Stroud, Smyrna, GA (US)

(73) Assignee: CALIFORNIA INNOVATIONS INC. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/074,946

(22) Filed: Dec. 5, 2022

(65) Prior Publication Data

US 2023/0099766 A1 Mar. 30, 2023

Related U.S. Application Data

(63) Continuation of application No. 16/703,103, filed on Dec. 4, 2019, now Pat. No. 11,518,583.

(51) Int. Cl.
*B65D 47/08* (2006.01)

(52) U.S. Cl.
CPC ..... *B65D 47/0847* (2013.01); *B65D 2543/00046* (2013.01); *B65D 2543/00092* (2013.01); *B65D 2543/00296* (2013.01)

(58) Field of Classification Search
CPC ..... B65D 47/0847; B65D 47/068; B65D 47/0804; B65D 47/0809; B65D 47/0838;
(Continued)

(56) References Cited

U.S. PATENT DOCUMENTS 2,272,867 A 2/1942 Cobel
3,146,904 A 9/1964 Hansen
(Continued)

FOREIGN PATENT DOCUMENTS

EP 0457961 A2 11/1991
EP 2295337 A1 3/2011
(Continued)

*Primary Examiner* — Jeffrey R Allen
(74) *Attorney, Agent, or Firm* — OSTROLENK FABER LLP

(57) ABSTRACT

A container assembly has a cup-shaped container, a lid body, a spout, a spout cover, and a spout cover securement, or lock. The lid body has a depending periphery that releasably mounts to the cup-shaped container. The lid body has a matrix extending within the periphery. The spout seat is located eccentrically and inwardly of the periphery. It has a root and a tip. The spout cover is movably mounted to the spout cover seat. When closed, the spout cover seals the spout. The lock moves between a first position and a second positon. In the first position the lock keeps the spout cover sealed to the tip. In the second position the spout cover securement permits motion of said spout cover to open. The lid is stackable on other lids. The container assembly cup comes in several forms, the different forms being mutually stacking.

24 Claims, 15 Drawing Sheets

(58) Field of Classification Search
CPC ..... B65D 47/0857; B65D 47/0828; A47G 19/2272
See application file for complete search history.

(56) References Cited

U.S. PATENT DOCUMENTS

| | | | | |
|---|---|---|---|---|
| 4,187,954 | A | 2/1980 | Striggow | |
| 4,570,817 | A | 2/1986 | Hambleton | |
| 4,776,475 | A | 10/1988 | La Vange | |
| 4,819,829 | A | 4/1989 | Rosten | |
| 4,838,441 | A | 6/1989 | Chernack | |
| 4,998,989 | A | 3/1991 | Curiel | |
| 5,400,912 | A | 3/1995 | Brown | |
| 5,779,110 | A | 7/1998 | Brown | |
| 6,702,137 | B1 | 3/2004 | Kowa | |
| 7,048,158 | B2 | 5/2006 | Hierzer | |
| 7,275,653 | B2 | 10/2007 | Tedford | |
| 7,594,587 | B2 | 9/2009 | Auer | |
| 7,594,588 | B2 | 9/2009 | Auer | |
| 8,408,414 | B2 | 4/2013 | Roth | |
| 8,689,989 | B2 | 4/2014 | Lane | |
| 8,777,039 | B2 | 7/2014 | Roth | |
| 8,813,982 | B2 | 8/2014 | Vangeel | |
| D643,305 | S | 8/2015 | Leija | |
| 9,138,088 | B2 | 9/2015 | Kemper | |
| 9,150,335 | B2 | 10/2015 | Lane | |
| 9,380,898 | B2 | 7/2016 | Mason | |
| 9,848,721 | B2 | 12/2017 | Turner | |
| 9,944,438 | B2 | 4/2018 | Roth | |
| 10,239,669 | B2 | 3/2019 | Ayriss | |
| 2002/0139767 | A1 | 10/2002 | Budd | |
| 2003/0136783 | A1 | 7/2003 | Hatsumoto | |
| 2007/0284392 | A1 | 12/2007 | Kaess | |
| 2009/0294459 | A1 | 12/2009 | Hovespian | |
| 2011/0174844 | A1* | 7/2011 | Hindle | B65D 47/2037 222/531 |
| 2013/0200088 | A1 | 8/2013 | Muir | |
| 2015/0282654 | A1* | 10/2015 | Kurabe | A47G 19/2272 220/254.5 |
| 2017/0112306 | A1 | 4/2017 | Muir | |
| 2017/0144808 | A1 | 5/2017 | Choltco-Devlin | |
| 2017/0313479 | A1* | 11/2017 | Li | B65D 47/0885 |
| 2018/0029758 | A1 | 2/2018 | Henson | |
| 2018/0170630 | A1* | 6/2018 | Ayriss | B65D 47/32 |
| 2018/0235844 | A1 | 8/2018 | Cox | |
| 2019/0100362 | A1 | 4/2019 | Meyers | |

FOREIGN PATENT DOCUMENTS

| | | | |
|---|---|---|---|
| EP | 2621825 | B1 | 7/2017 |
| EP | 2708473 | B1 | 11/2017 |
| EP | 3083443 | B1 | 6/2018 |
| EP | 3215423 | B1 | 10/2018 |

* cited by examiner

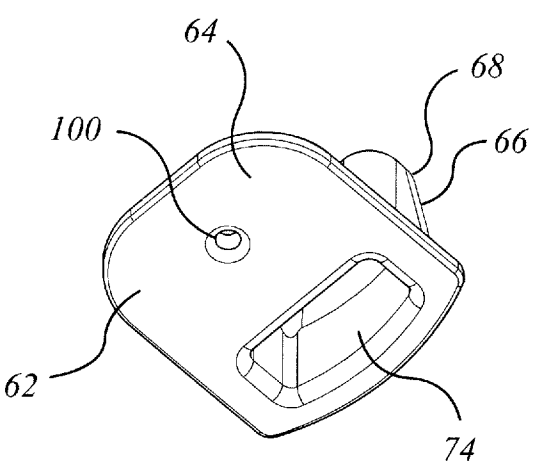
FIG. 7b
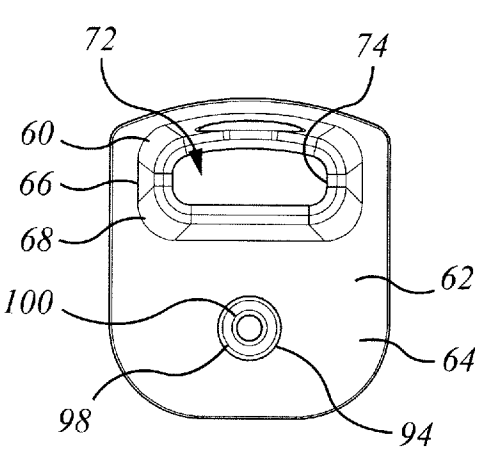
FIG. 7c
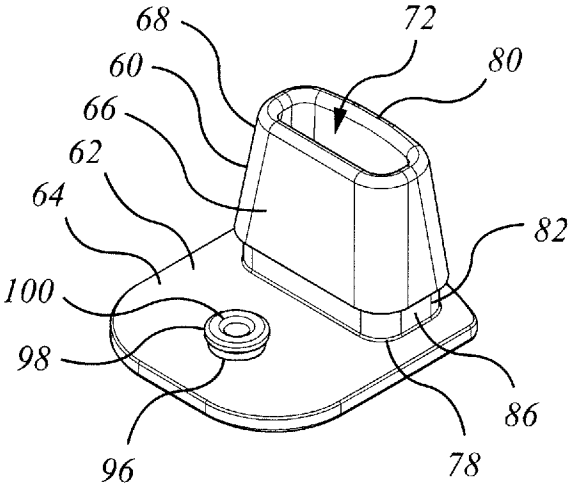
FIG. 7a
FIG. 7g
FIG. 7f
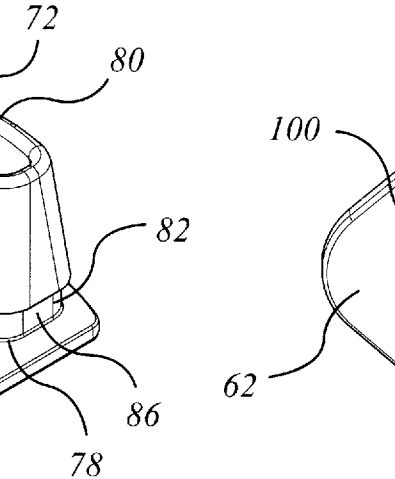
FIG. 7e
FIG. 7d

CONTAINER ASSEMBLY

FIELD OF THE INVENTION

This invention relates to the field of portable containers for liquids.

BACKGROUND OF THE INVENTION

Liquid containers are popular consumer items. In one application, liquid containers may be used to hold liquid beverages. Sometimes it is desirable to have a beverage for sipping without spilling. To that end beverage containers are sometimes provided with a spout or mouthpiece, or in the case of drink containers for small children, with a nipple as on a baby's bottle. In a cup-shaped container, the spout or outlet may be placed eccentrically, such as with a spout that is placed at, or relatively close to, the rim of the cup. The mouthpiece may have a greater extent in the circumferential direction of the cup, and a smaller extent in the radial direction. For both storage and shipping, it may be helpful for the cups to be stackable, and also for the lids to be stackable. Additionally, sometimes the user would like a hot item, and sometimes a cold item. Sometimes the user may be indifferent to whether the liquid container is insulated, or not. In that regard, the user may want different kinds of containers, yet ones that still fit generally the same space envelope, to the extent of being commonly stackable, and that may be used interchangeably with the lid.

SUMMARY OF THE INVENTION

In an aspect of the invention there is a container lid assembly comprising. It has a body, a spout, a spout cover, and a spout cover securement, or lock. The body has a depending periphery that is releasably engageable to a liquid containment vessel. The body has a matrix extending within the periphery. The spout is located eccentrically and inwardly relative to the periphery. The spout has a root that is removably engaged to the matrix, and a tip that extends axially outwardly relative to the matrix. The spout cover is movably mounted to the matrix, and is movable in a first degree of freedom between a closed position and an open position. In the closed position the spout cover is in sealing engagement with the spout, and in the second position the spout cover is clear of the spout. The spout cover securement, or lock, is mounted to the body. The lock is movable in a second degree of freedom between a first position and a second positon. In the first position the spout cover securement retains the spout cover in sealing engagement of the tip of the spout. In the second position the lock permits motion of the spout cover in the first degree of freedom.

In a feature of that aspect container lid assembly, the spout is made from a different material than the body. In another feature, at least one of: (a) the spout is made of a flexible polymer; and (b) the body is made of a plastic that is more rigid than is the spout. In another feature, the assembly has a pressure relief port. In the closed position of the spout cover, the spout cover also closes the pressure relief port. In yet another feature, the root of the spout includes the pressure relief port. In still another feature, the lid assembly is a first lid assembly. The first lid assembly is stackable on top of a second such lid assembly. In an additional feature, the matrix has a relief defined therein. The relief is sized to accommodate the spout and spout cover of the second lid assembly. In another additional feature, the body has a depending peripheral skirt, and an upwardly facing peripheral seat. The skirt is sized matingly to engage the peripheral seat, whereby the skirt of the first lid assembly and the peripheral seat of the second lid assembly are mutually engaging.

In another feature, the lock is slidingly movable. In an additional feature, the spout cover has a protrusion. The body includes a guideway. The lock includes a car constrained to follow the guideway. In the first position of the car captures the protrusion, pressing the cover against the tip. In another feature, the spout is made of silicone, and the body is made of a harder material than the spout. In still another feature, the first degree of freedom of motion of the spout cover is pivotal movement about an axis of rotation. In a further feature, the second degree of freedom of motion of the lock is circumferential translation along a portion of the body. In a still further feature, the first degree of freedom of motion of the spout cover is pivotal movement about an axis of rotation. The second degree of freedom of motion of the lock is circumferential translation along a portion of the body. In another feature, the depending periphery is threaded and is releasably engageable with a mating threaded margin of the liquid container vessel.

In another aspect of the invention there is a set of mutually nesting hand-held liquid containment drinking vessels. The set includes at least first, second and third containment vessels. At least the first containment vessel has different physical properties than at least the second containment vessel. Each of the containment vessels has an engagement fitting operable to engage a mating fitting of a respective lid and to secure said respective lid thereto. The lids of the respective containment vessels are mutually stackable upon each other.

In a feature of that aspect, the first containment vessel differs from the second containment vessel in at least one of (a) liquid containment wall structural material; (b) thermal insulation properties; (c) external hand grip configuration; (d) containment volume; and (e) height. In another feature, one of the containment vessels has a stainless steel liquid containment wall and another of the containment vessels has a molded polymer liquid containment wall. IN a further feature, the liquid containment vessels are drinking mugs and the lids provide a closable cover thereof. The lids have a spout; a releasably securable spout cover; and a lock operable to secure the spout cover in a liquid-tight closed condition. In a further feature, there are at least three different kinds of liquid containment vessels. In another feature, all of the containment vessels of the set differ from each other.

The features of the aspects of the invention may be mixed and matched as appropriate without need for multiplication and repetition of all possible permutations and combinations.

BRIEF DESCRIPTION OF THE DRAWINGS

These and other aspects and features of the invention may be more readily understood with the aid of the illustrative Figures below, showing an example, or examples, embodying the various aspects and features of the invention, provided by way of illustration, and in which:

FIG. 7*a* is an isometric view from the rear, right and above of the drinking spout or nipple of the container lid assembly of FIG. 2*a;*

FIG. 7*b* is an isometric view form the rear, right, and below of the drinking spout of FIG. 7*a;*

FIG. 7*c* is a top view of the drinking spout of FIG. 7*a;*

FIG. 7*d* is a bottom view of the drinking spout of FIG. 7*a;*

FIG. 7*e* is a rear view of the drinking spout of FIG. 7*a;*

FIG. 7*f* is a left hand side view of the drinking spout of FIG. 7*a*, the right hand side view being a mirror image thereof;

FIG. 7*g* is an isometric view of an alternate arrangement to FIG. 7*a* in which the drinking spout and air vent are separate items;

DETAILED DESCRIPTION

Figure 1A:
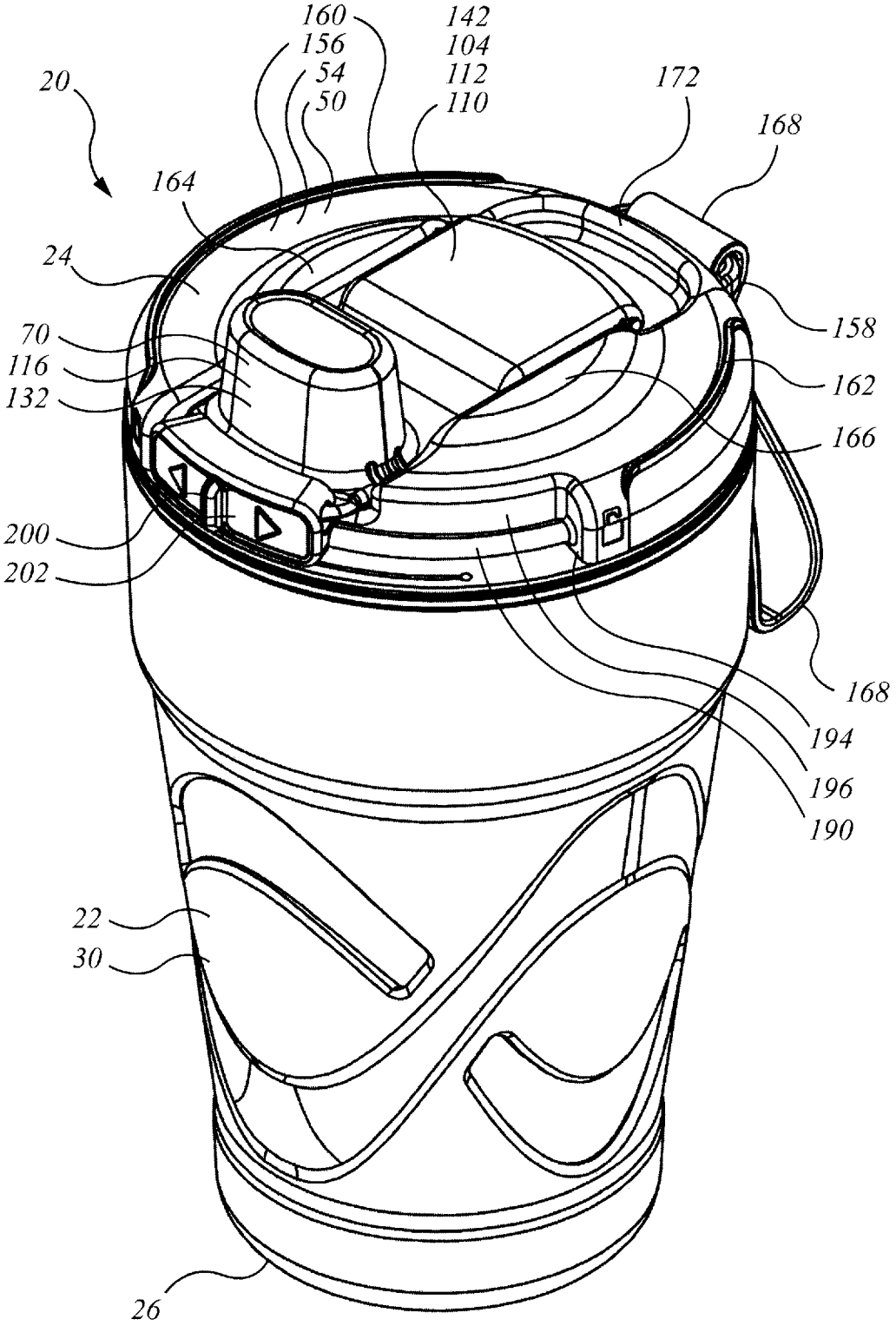
FIG. 1*a* is an isometric view of a liquid container assembly that includes a liquid container lid assembly, and a mating liquid container vessel.
Figure 1C:
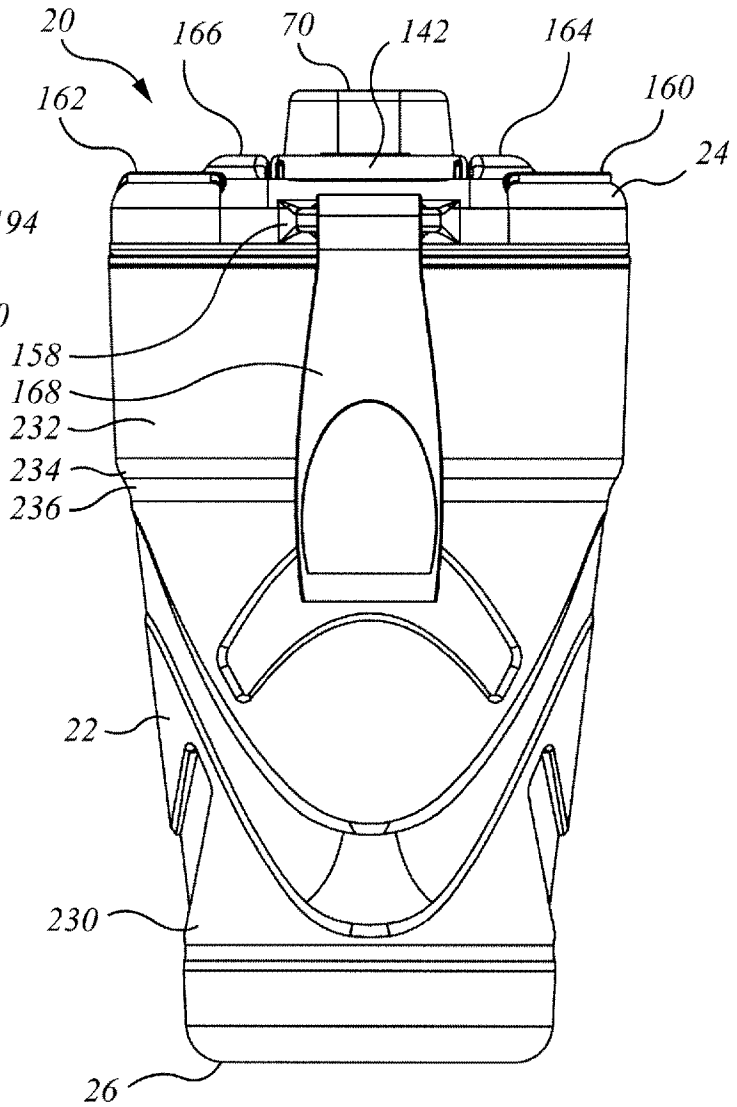
FIG. 1*c* shows a rear view of the liquid container assembly of FIG. 1*a;*
Figure 1B:
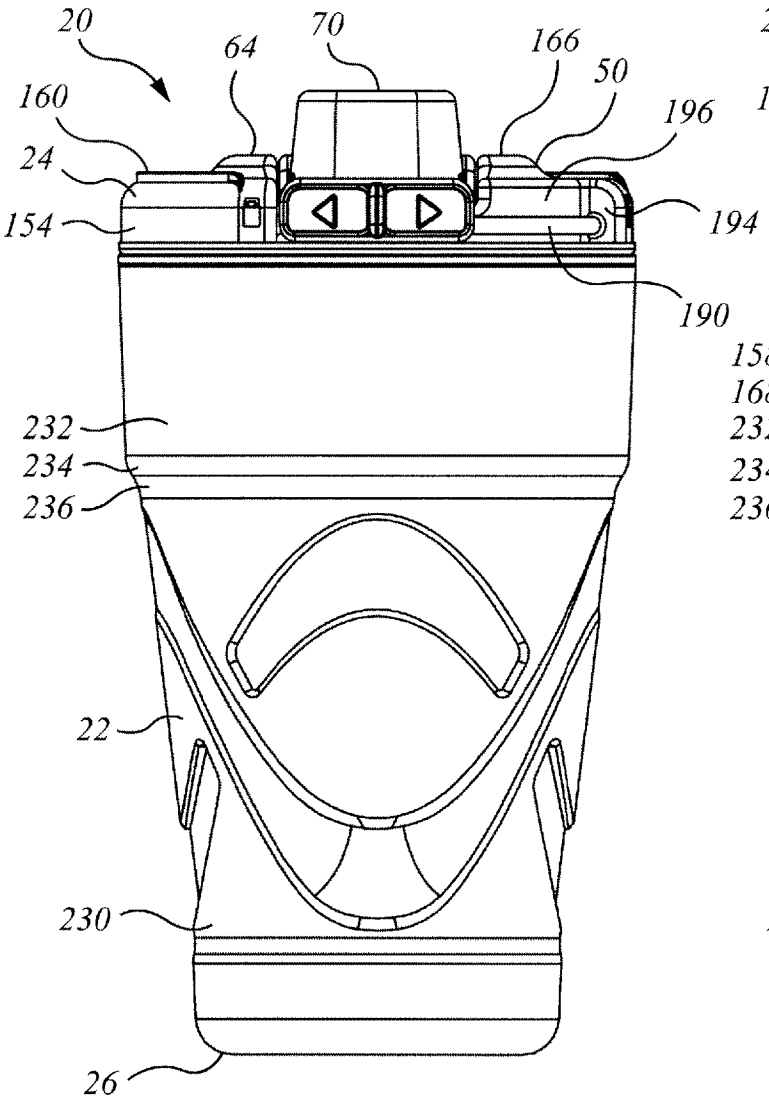
FIG. 1*b* shows a front view of the liquid container assembly of FIG. 1*a;*
Figure 1E:
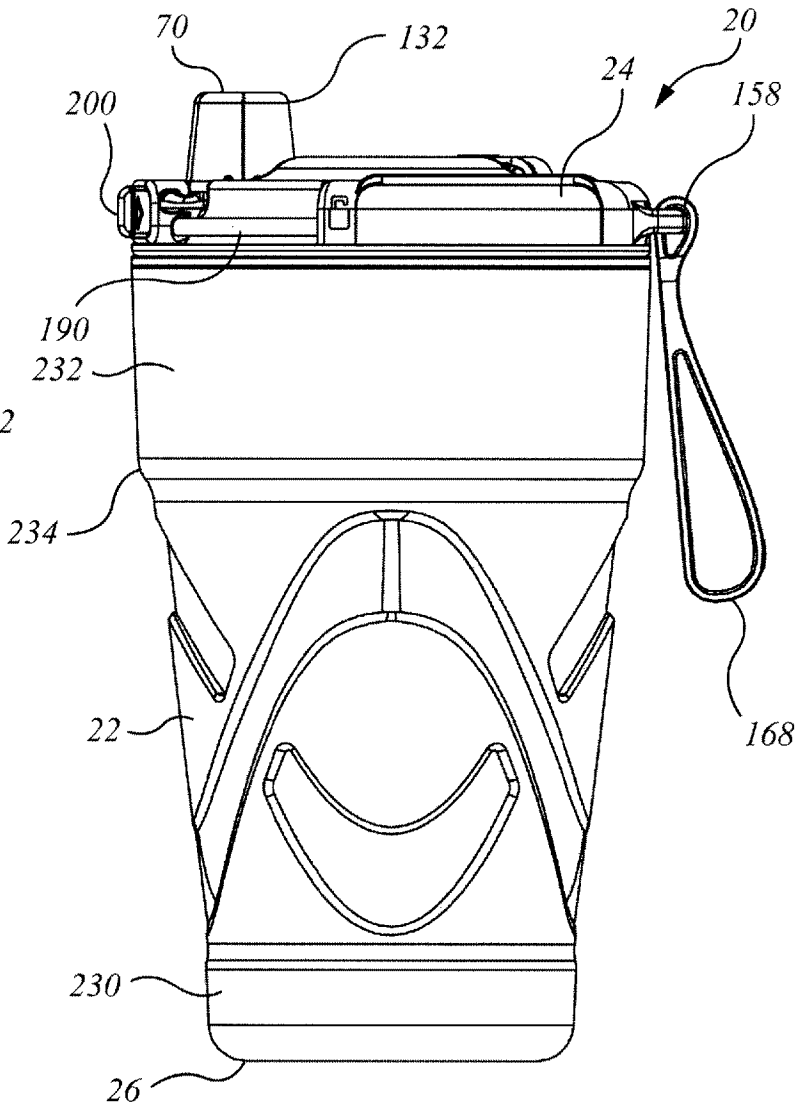
FIG. 1*e* is a left hand side view of the container assembly of FIG. 1*a;*
Figure 1D:
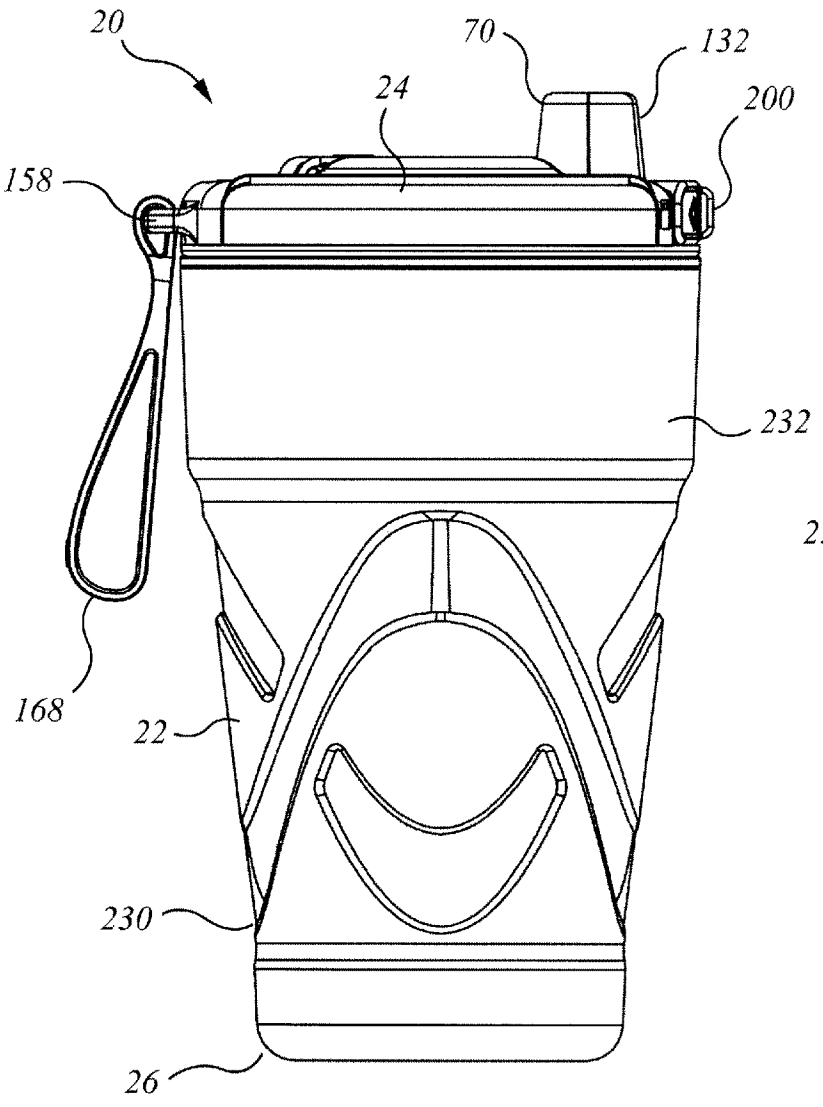
FIG. 1*d* is a right hand side view of the container assembly of FIG. 1*a;*
Figure 1G:
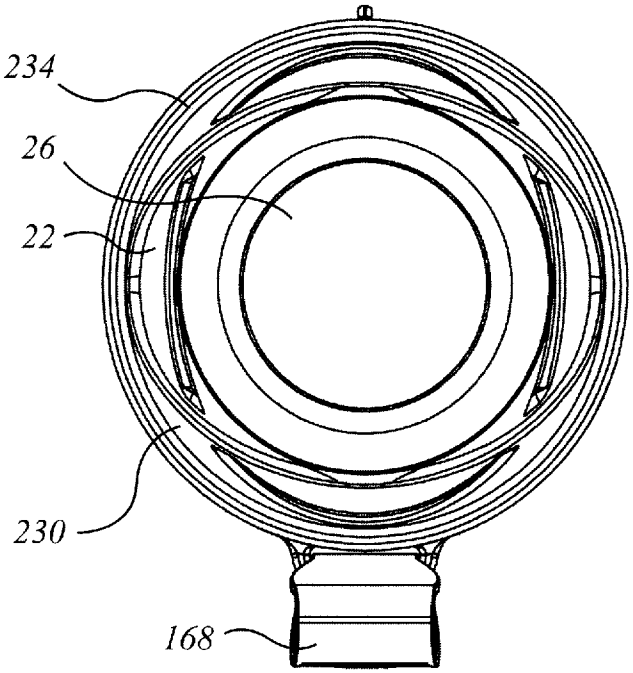
FIG. 1*g* is a bottom view of the container assembly of FIG. 1*a;*

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated to depict certain features of the invention.

In this specification reference is made to insulated containers. It should be understood that, within the normal range of temperatures to which human food and human touch is accustomed, although the term cooler, or cooler container, may be used, such insulated structures may generally also be used to aid in keeping food, beverages, or other objects either warm or hot as well as cool, cold, or frozen. The adjective "insulated" is intended to be given its usual and normal meaning as understood by persons skilled in the art. It is not intended to encompass single layers, or skins, of conventional webbing materials, such as Nylon (t.m.), woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from *Phillips* v. *AWH Corp.,* this definition provided herein is intended to supplant any dictionary definition, and to prevent interpretation in the US Patent Office (or any other Patent Office) that strays from the customary and ordinary meaning of the term "insulated". The Applicant also explicitly excludes cellophane, waxed paper, tin foil, paper, or other single use disposable (i.e., not intended to be re-used) materials from the definition of "washable".

Similarly, this description may use multiple nouns when providing nomenclature for the features annotated in the drawings. The multiple nouns are used as synonyms, and the detailed description is used as a thesaurus to convey understanding at both the specific level and at the broader conceptual level. English often has many terms for the same item, and where multiple terminology is provided, the description is showing that any synonym for the item is to be included in the understanding of the feature, and that it is not limited to one particular noun.

FIGS. 1*a*-1*e*, show a liquid container assembly generally as 20. Liquid container assembly 20 has a first portion 22, and a second portion 24. First portion 22 and second portion 24 are mutually engageable, and are separable to permit liquid to be placed in first portion 22. First portion 22 may be thought of, and may also be termed, a cup or cup assembly, be it large or small. Second portion 24 is a closure that mates with first portion 22. Second portion 24 may likewise be thought of as a lid for the cup defined by first portion 22. Second portion 24 is removable, and re-usable. Usually, when container assembly 20 is sitting at rest on a surface such as a table or counter-top, or in a drink-holder in a vehicle, first portion 22 is the lower or bottom, or base portion of container assembly 20, and second portion 24 is the upper or top portion. The terms "upper" and "lower" are determined by the direction of gravity when assembly 20 is standing upright, or predominantly upright (i.e., the cup may not always be placed on a precisely flat, level, horizontal surface). However, by its nature, a drinking apparatus such as liquid container assembly 20 may be inverted to some extent when drinking occurs, and it may be dropped, or carried in a bag or other container in which it is not necessarily always upright. In that sense, the designation "upper" or "lower" or "top" or "bottom" is to some extent arbitrary.

In general, first portion 22 may also be referred to as the body of liquid container assembly 20, and may also be termed a vessel, can, canister, jug, stein, mug, base, container, glass, vase, canteen, tumbler, reservoir, cup, cup-shaped container and so on. However it may be termed, it is a vessel in which to hold and transport liquid. The liquid may be a beverage. Usually, when container assembly 20 sits at rest on a surface such as a table or counter-top, or in a drink-holder in a vehicle, first portion 22 is the lower or bottom, or base portion of container assembly 20, and second portion 24 is the upper or top portion. Similarly, there is a variety of names that may be used for second portion 24. It may be termed a closure, or closure member, or closure assembly, or cap, or lid, or cover, or top. There are many possible terms that could be used as nomenclature for an object or assembly that mates with, and provides a covering for, the vessel for containing liquids. From this point, first portion 22 will be referred to as the cup or main body; and, similarly, second portion 24 will be referred to as the container lid assembly.

Figure 9A:
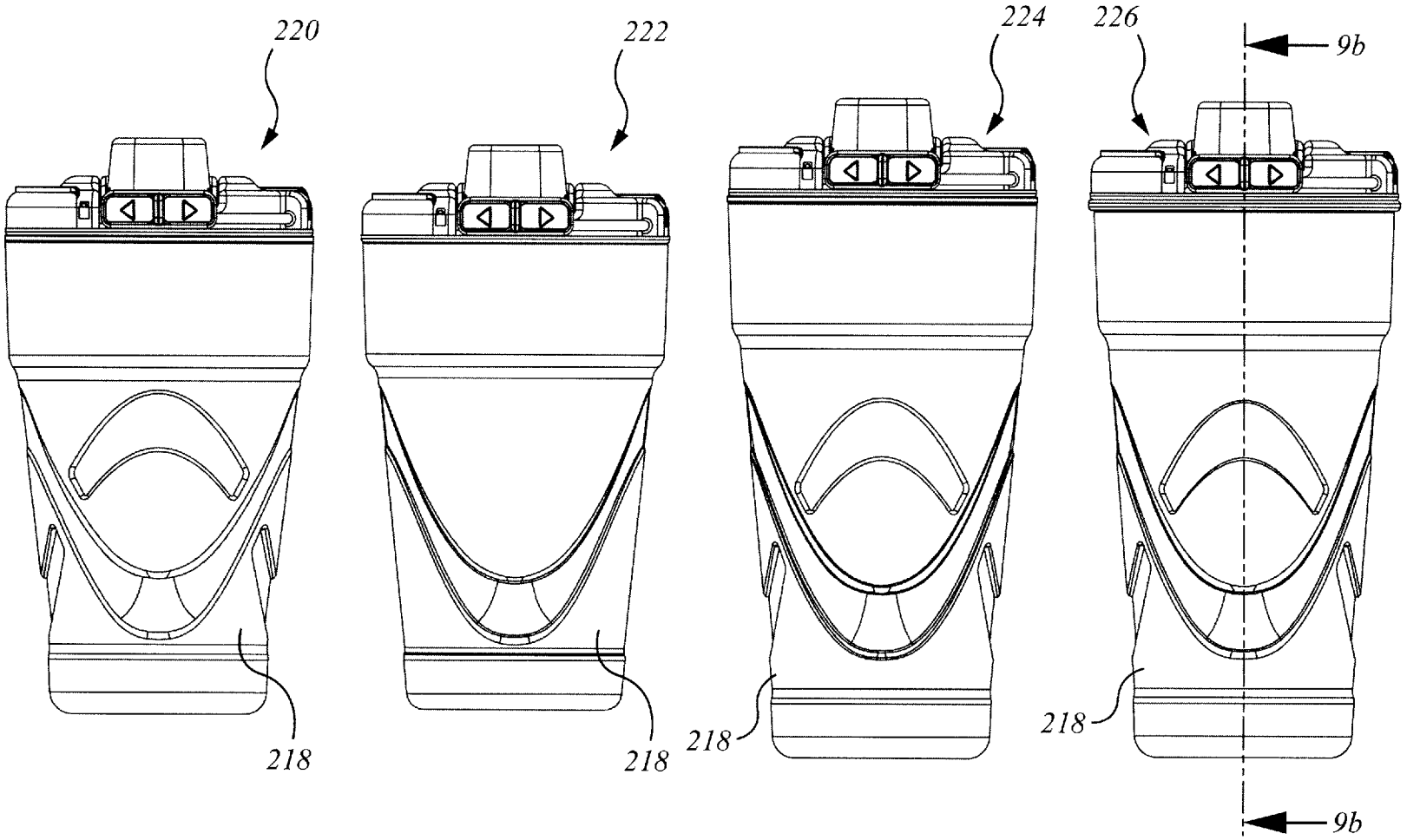
FIG. 9*a* shows front views of a family of the container assemblies as in FIG. 1*a;*
Figure 9B:
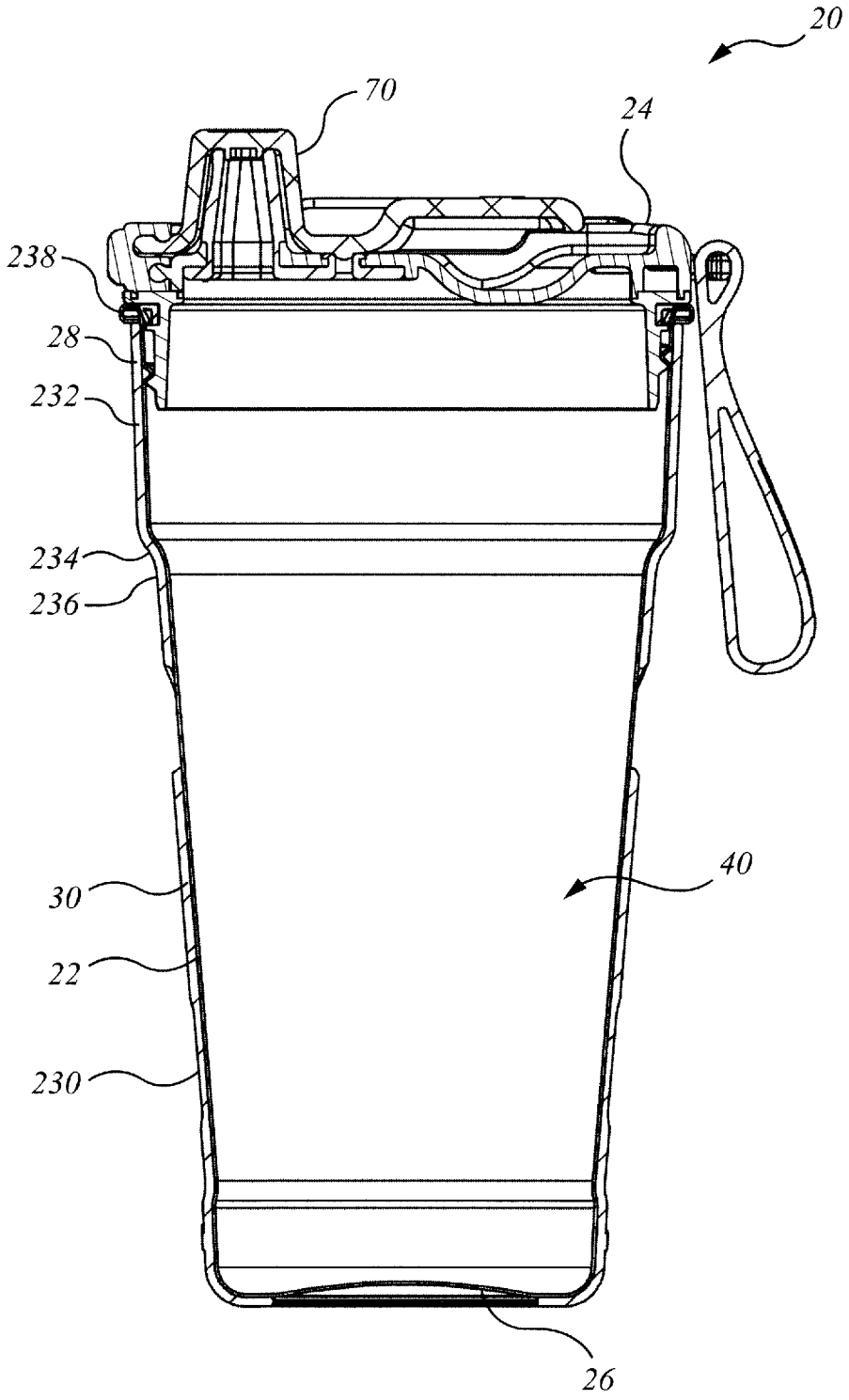
FIG. 9*b* shows a sectional view of one of the container assemblies of FIG. 9*a* taken on section '9*b*-9*b*'.
Figure 9C:
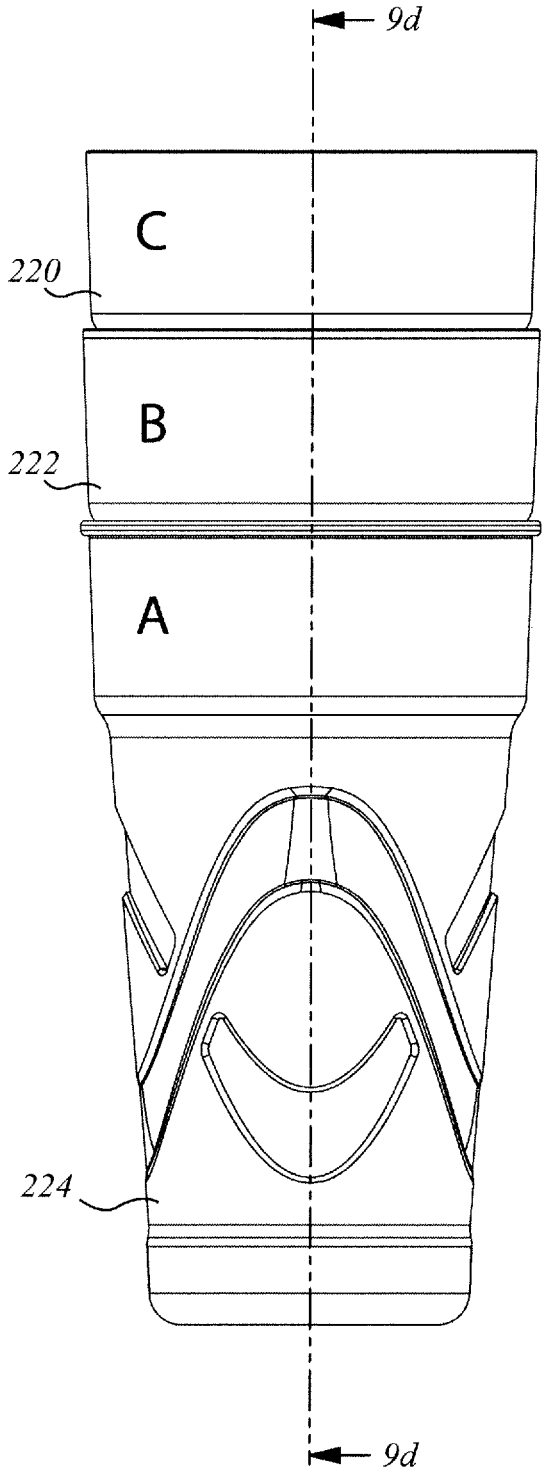
FIG. 9*c* shows members of the liquid container bodies of the family of liquid container assemblies of FIG. 9*a* stacked together.
Figure 9D:
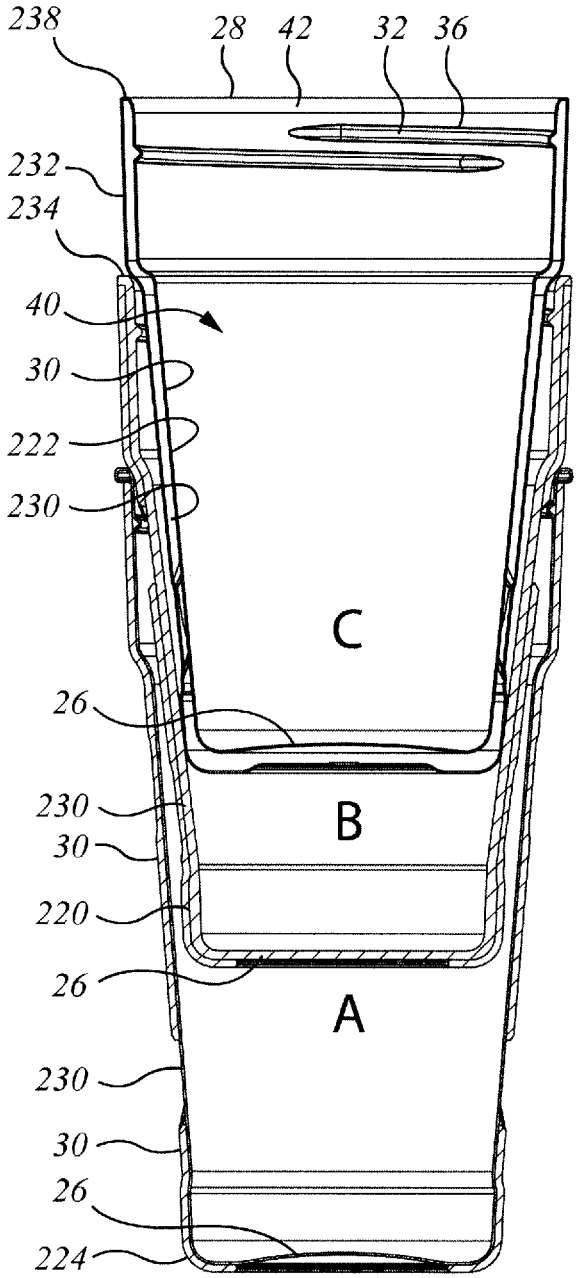
FIG. 9*d* shows a section of the stacked container body members of FIG. 9*c*.

Although several examples of cup are discussed below, each with different properties, they all provide a circular cylindrical frame of reference, or geometric context, for the description of liquid container assembly 20 more generally. That is, the examples of main body 22 herein have the common feature of axial direction, or z-axis, which is nominally vertical when container assembly 20 stands on a surface, and which is measured upwardly from the first end, or bottom, or base, or bottom wall 26 of main body 22, however it may be called. Main body 22 also has a second end, or top end, that defines the uppermost margin, or lip, or rim 28 of main body 22 most distant from bottom wall 26. Main body 22 also has a sidewall that extends between bottom wall 26 and rim 28. The juncture of bottom wall 26 and sidewall 30 is formed to contain liquid, whether they are separate parts that are joined together, or made from a single part that is molded or extruded as a one-piece unit. That is, main body 22 is hollow, and defines an internal chamber 40 in which liquid is contained. Chamber 40 has an opening 42 that is surrounded by, and is defined by, rim 28. Further, although main body 22 could be non-circular at any axial station along the z-axis, e.g., it could be square, or rectangular, or elliptical or oval, as may be, it is convenient that sidewall 28 be a body of revolution about the z-axis, and that the body of revolution be circular, or largely circular, at any given section. Since container body 22 is to be stackable with other container bodies of the same or similar type, the girth of body 22 (i.e., the periphery, circumference, or vertically projected outline at that axial section) increases from bottom wall 26 to rim 28. As illustrated in FIGS. 1*b*, 1*c*, 1*d* and 1*e*, it may be convenient for that increase to be along a taper, such that container body 22 is, or largely approximates, a truncated conical body, such that successive cups will nest inside each other as shown in FIGS. 9*c* and 9*d*. As a body of revolution, container body 22 has, in addition to an axial direction or z-axis, a radial direction, r, measured away from the z-axis, and a circumferential direction around the z-axis, the axial, radial, and circumferential directions being mutually perpendicular and defining a polar cylindrical co-ordinate system as a frame of reference.

Another feature common to the examples herein is that the second end of container body 22 has a mounting interface, or fitting, 32 that mates with a corresponding mounting interface, or fitting, 34 of container lid assembly 24. These first and second mounting interfaces, or fittings, 32 and 34 are mutually engageable and disengageable to permit container lid assembly 24 to be removed so that body 22 can be filled, (or emptied and cleaned), as may be appropriate after use. Further, when separated, the various cups of FIGS. 9*a*-9*d* are stackable, and the separated container lid assemblies are also stackable. In the examples illustrated, mounting fittings 32 and 34 are mutually engaging male and female threads. It is arbitrary which is male, and which is female. It is also arbitrary whether one goes on the inside or on the outside of main body 22 or lid assembly 24. In the examples illustrated, rim 28 is internally threaded, and the mating portion of lid assembly 24 is externally threaded. That is, mounting fitting 32 is an internal thread 36, and mounting fitting 34 is an external thread 38.

Having established a frame of reference, consider container lid assembly 24. It has a body 50. Body 50 has a peripheral wall 52 and a top or roof, or cover, or spanning member identified as a top wall or matrix 54 that extends cross-wise inwardly of the peripheral wall such that, when lid assembly 24 is mounted to main body 22, body 50 extends across and covers, or substantially covers, opening 42. Matrix 54 is the main part of the lid that covers the opening of the cup. By spanning opening 42, and thereby obstructing it, top wall or matrix 54 serves to retain the contents of chamber 40. Peripheral wall 52 includes a depending skirt 56 that includes mounting fitting 34.

Container lid assembly 24 also includes a drinking spout 60, which may sometimes be referred to as a nipple; and a drinking spout cover 70. Drinking spout 60 may be, or may be part of, a molded part 62. Drinking spout 60 may be made of a flexible, material. That material may be a flexible polymer. It may be a rubber, or rubber-like substance such as a silicone. In the example, a formed part 62 has a base, or foot, or wall, or root 64 that seats in a mating accommodation, or recess, 46, in the underside of matrix 54. However it may be termed, the actual drinking interface, or nipple, or nozzle, or mouthpiece, 66, has the form of a hollow protrusion 68 that stands proud of, and extends upwardly away from, matrix 54. It has an opening 72 formed at the distal end, i.e., the end most distant from root 64, and therefore most distant from matrix 54. Opening 72 may be a round or oval or generally similar shaped hole or opening, and permits flow through passageway 74 formed inside hollow protrusion 68. Alternatively, in some embodiments, as used for small children it may have the form of a reed valve, or the equivalent thereof, formed by making slits, such as a cross-shaped slit, in the end of the bulb. In that alternative, when the end is squeezed, or when a pressure difference is established across the membrane, the cross-shaped slit allows liquid to flow out.

Figure 2A:
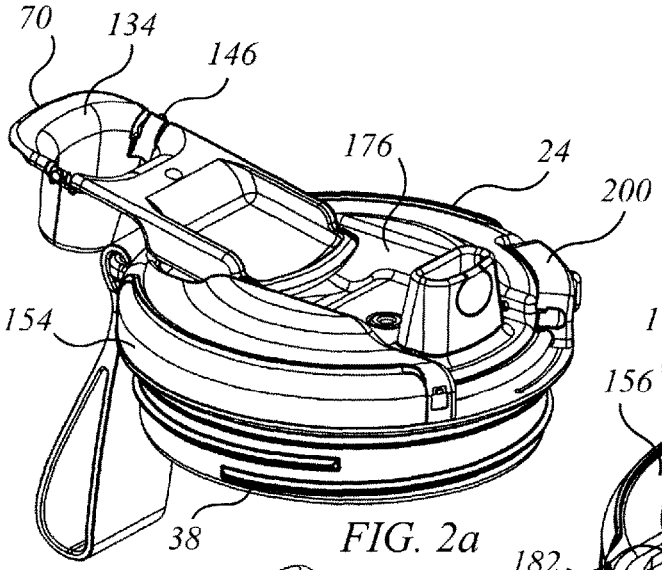
FIG. 2*a* is an isometric view from in front and to one side of the container lid assembly of FIG. 1*a* with the lid spout cover open.
Figure 2B:
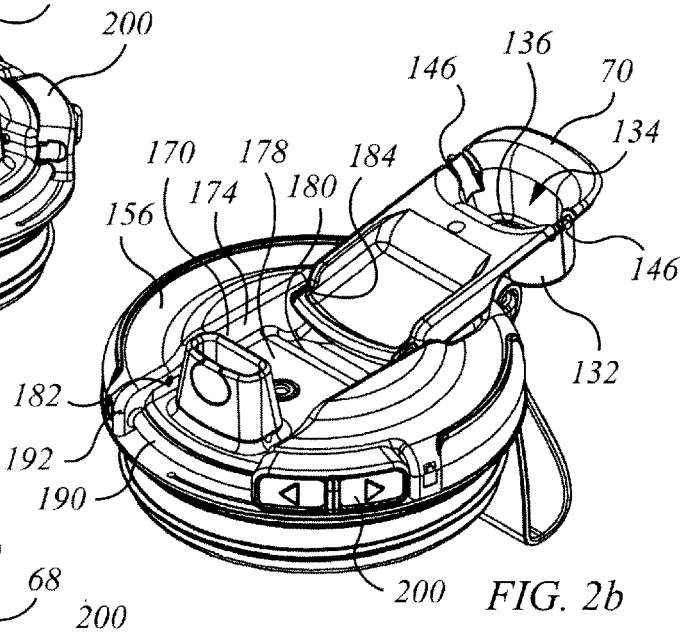
FIG. 2*b* is an isometric view from in front and to the other side of the container lid assembly of FIG. 2*a;*
Figure 2C:
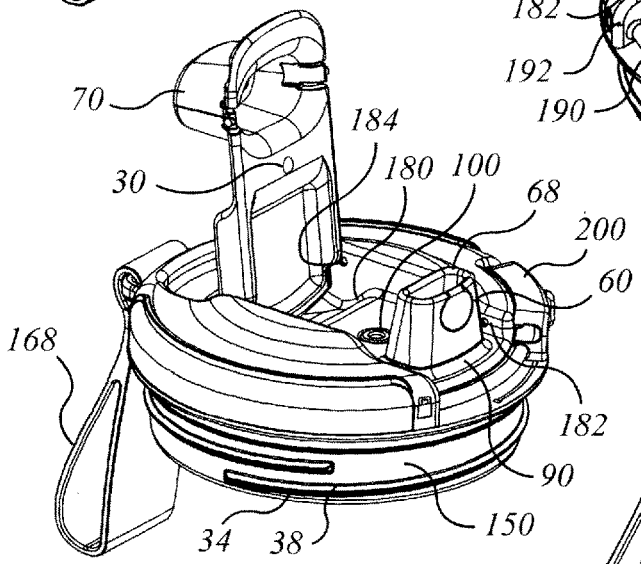
FIG. 2*c* is an isometric view from the same vantage point of FIG. 2*a* with the spout cover in an upright orientation.
Figure 2D:
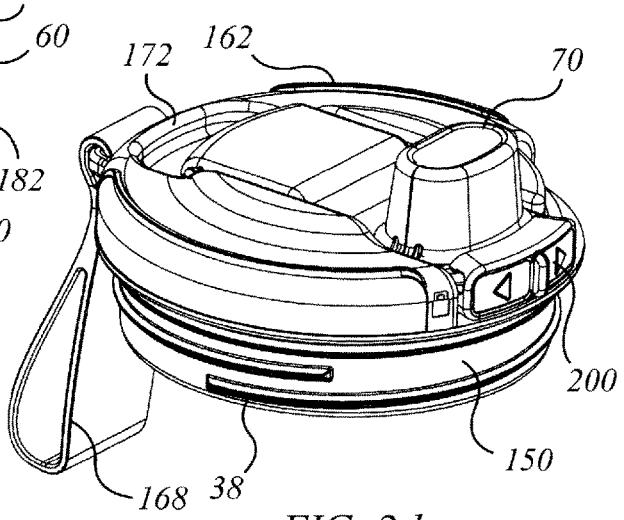
FIG. 2*d* is an isometric view of the container lid assembly from the vantage point of FIG. 2*a* with the spout cover in the closed position, and locked.
Figure 2E:
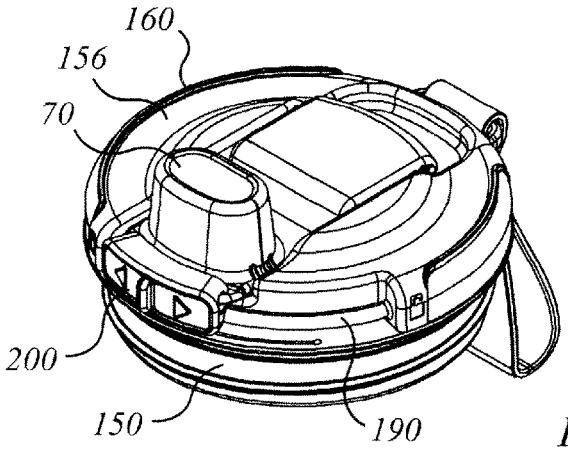
FIG. 2*e* is an isometric view of the container lid assembly of FIG. 2*d* in the closed position and locked as in FIG. 2*d;*
Figure 3B:
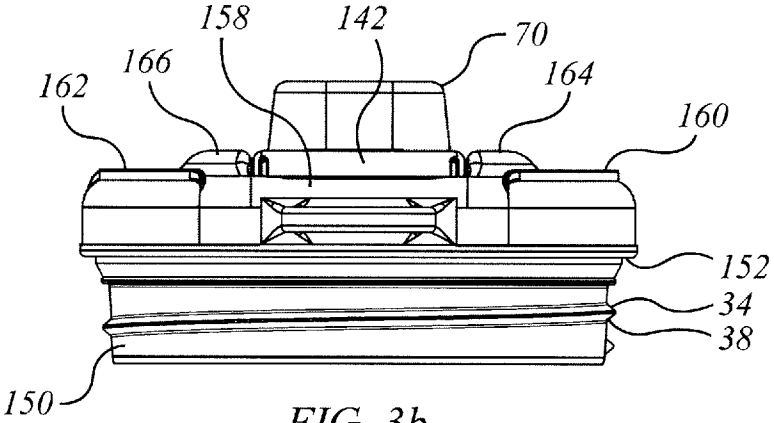
FIG. 3*b* is a rear view of the container lid assembly of FIG. 3*a;*
Figure 3D:
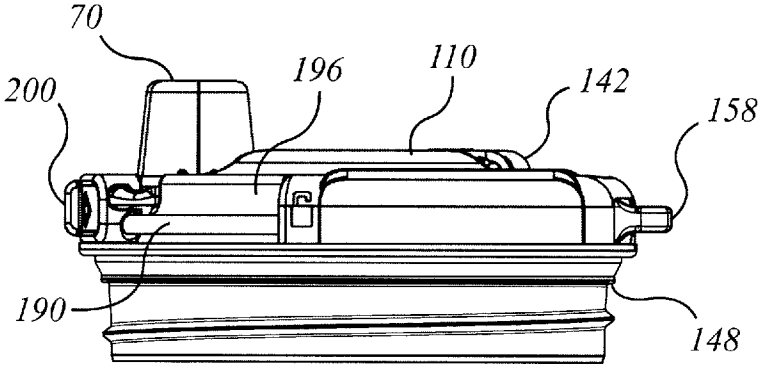
FIG. 3*d* is a left hand side view of the container lid assembly of FIG. 3*a;*
Figure 3A:
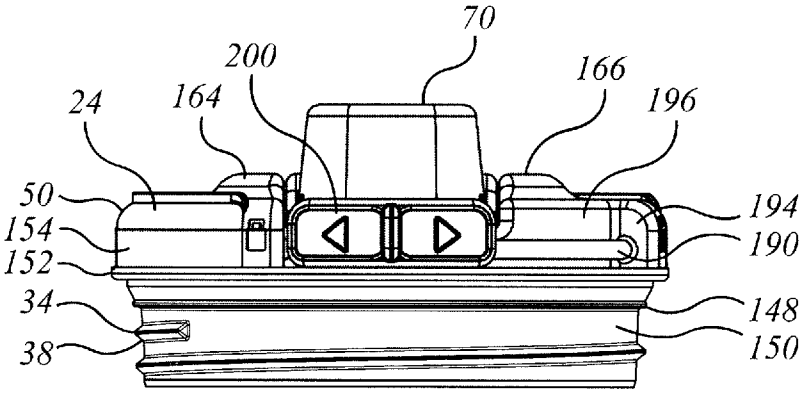
FIG. 3*a* is a front view of the container lid assembly of FIG. 2*a* with hang strap removed.
Figure 3C:
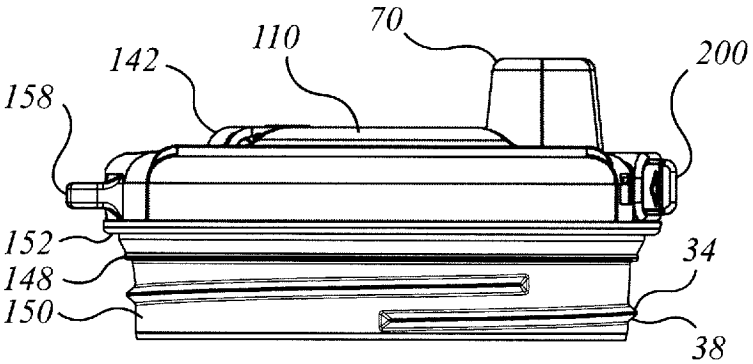
FIG. 3*c* is a right hand side view of the container lid assembly of FIG. 3*a;*
Figure 3F:
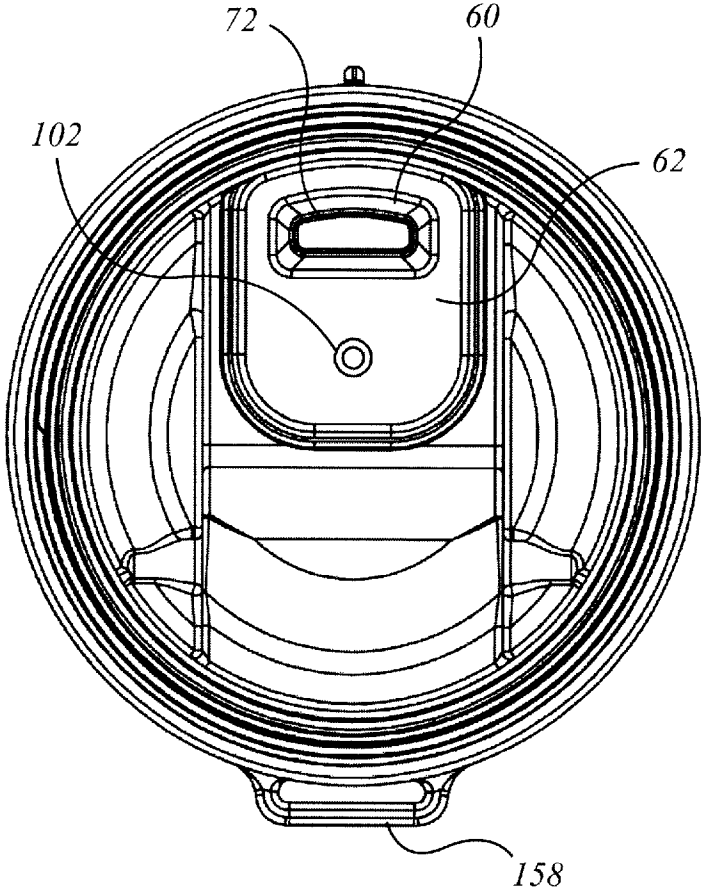
FIG. 3*f* is a bottom view of the container lid assembly of FIG. 3*a;*
Figure 3E:
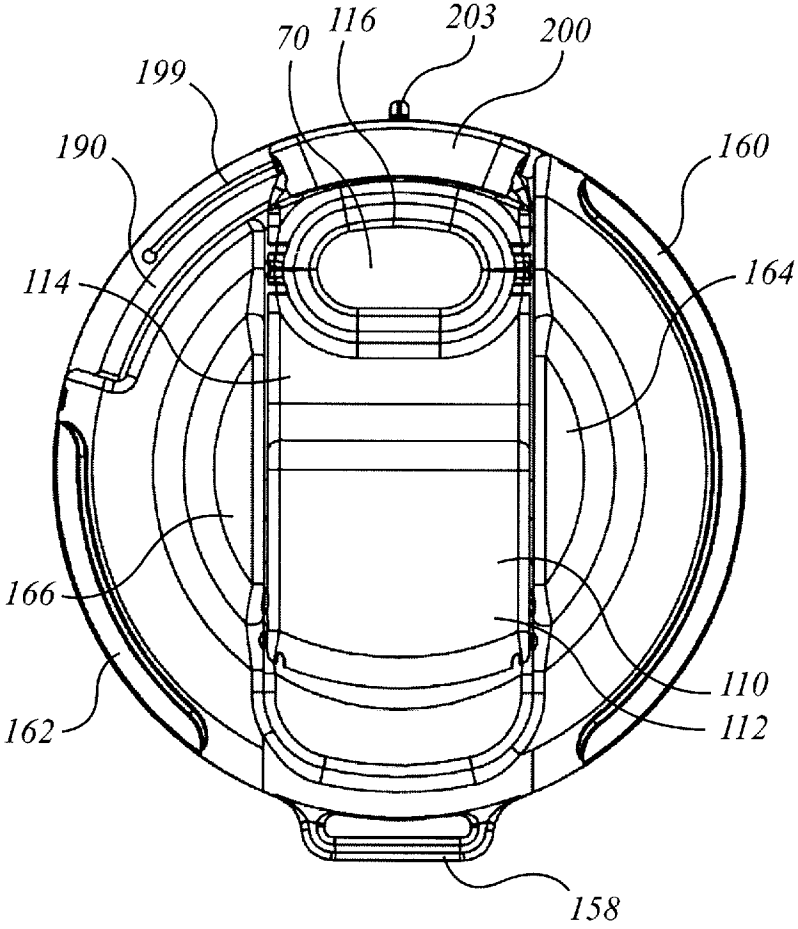
FIG. 3*e* is a top view of the container lid assembly of FIG. 3*a;*
Figure 5A:
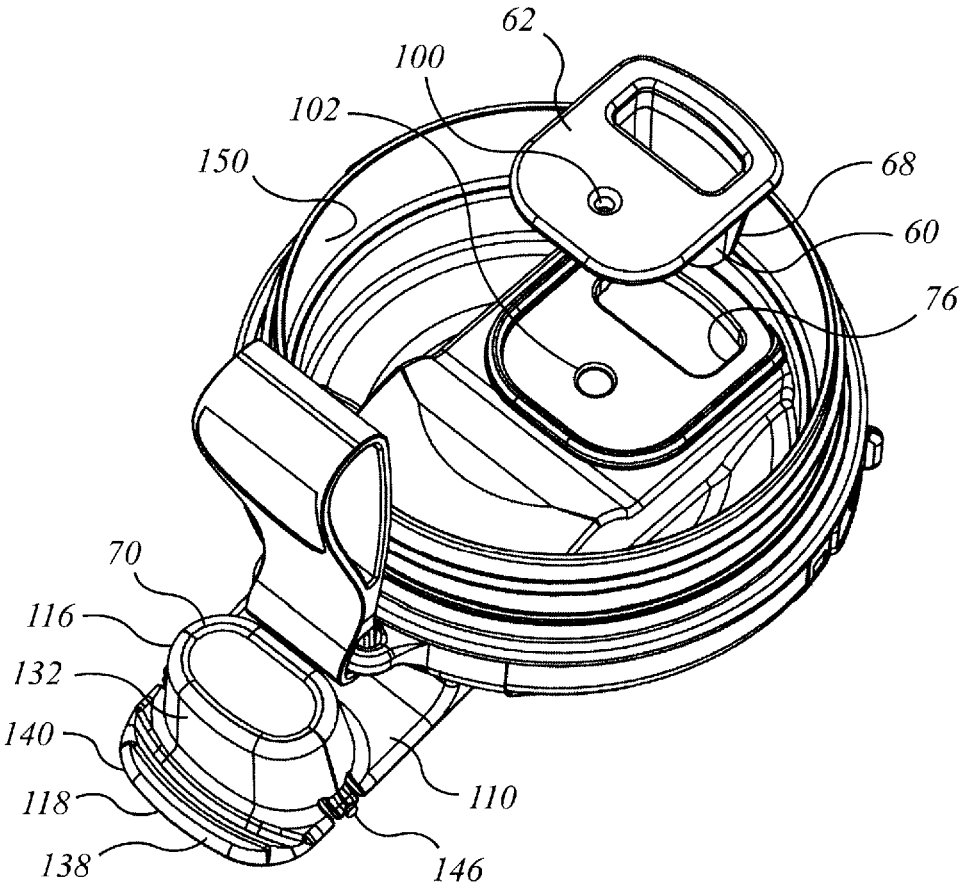
FIG. 5*a* is an inverted isometric view of the container lid assembly of FIG. 2*b*, showing the drinking spout nipple prior to insertion.
Figure 5B:
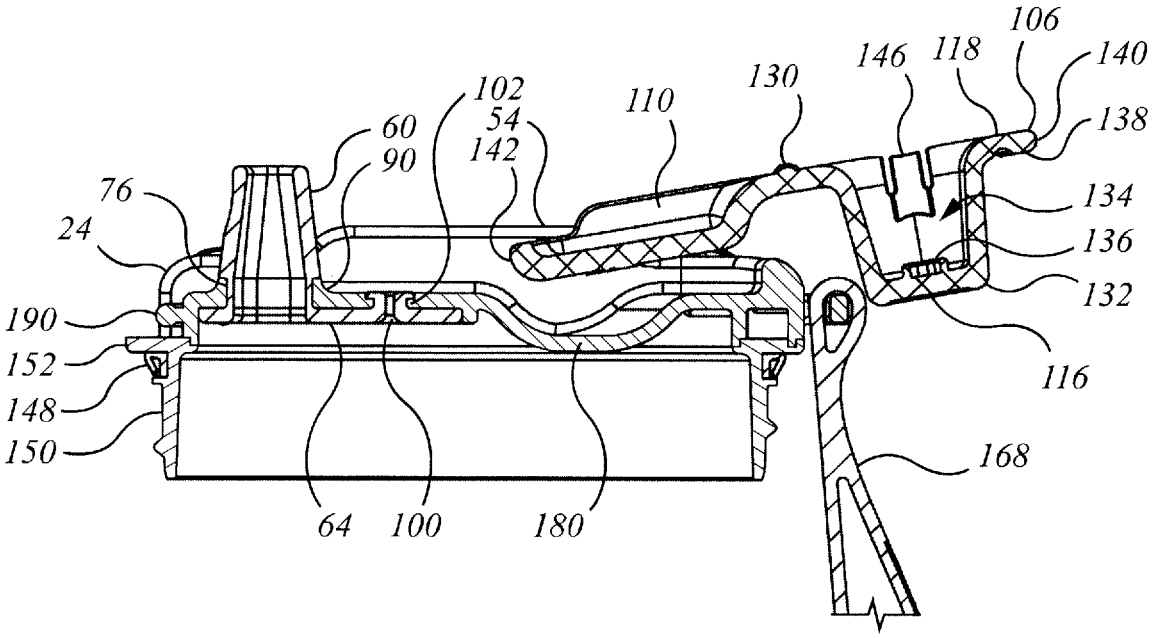
FIG. 5*b* is a section of the container lid assembly of FIG. 2*b* taken on the centerline with the spout cover open.
Figure 6C:
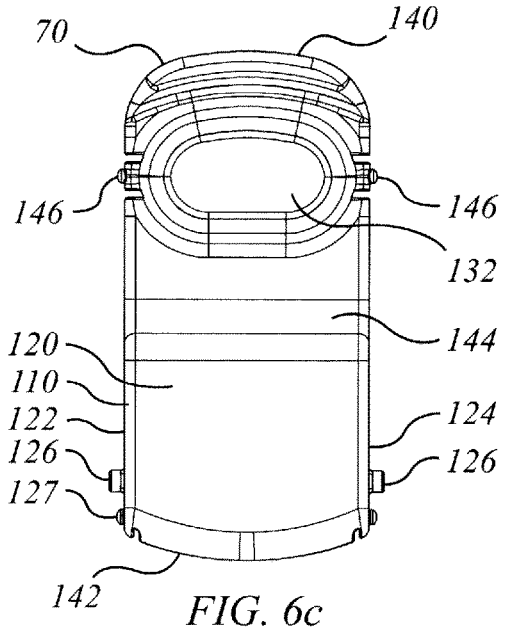
FIG. 6*c* is a top view of the spout cover of FIG. 6*a;*
Figure 6A:
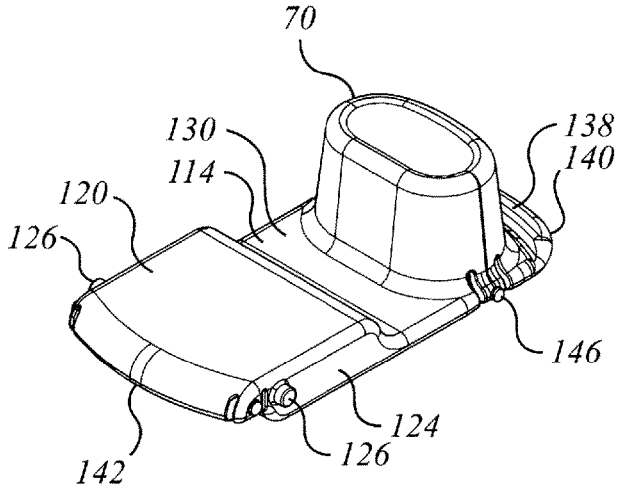
FIG. 6*a* is an isometric view from above, rear and right of the spout cover of the container lid assembly of FIG. 2*a;*
Figure 6F:
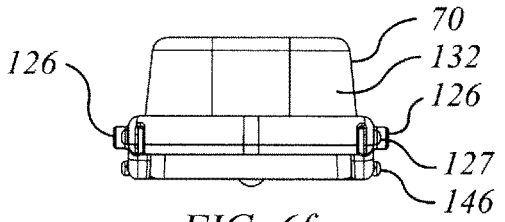
FIG. 6*f* is a rear view of the spout cover of FIG. 6*a;*
Figure 6E:
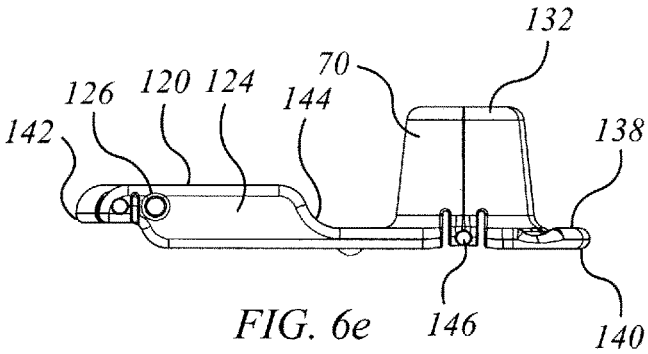
FIG. 6*e* is a right-hand side view of the spout cover of FIG. 6*a*, the left-hand side view being a mirror image thereof.
Figure 6D:
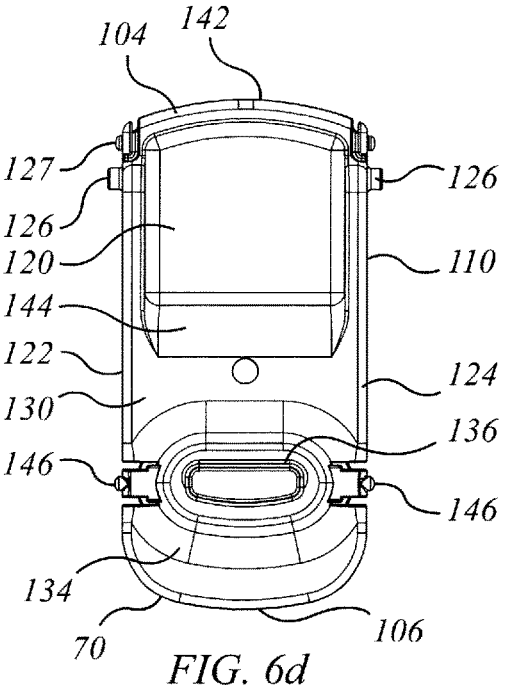
FIG. 6*d* is a bottom view of the spout cover of FIG. 6*a;*
Figure 6B:
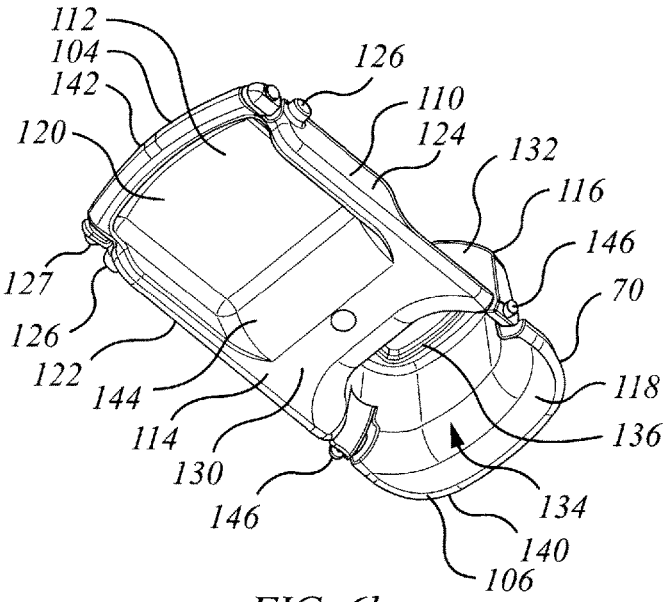
FIG. 6*b* is an isometric view from the rear, right, and below, of the spout cover of FIG. 6*a;*

As seen in the Figures, matrix 54 of body 50 has a wall penetration or opening 76 that accommodates protrusion 68. That is, on installation protrusion 68 is inserted from beneath matrix 54, as in FIG. 5*a*; and then pushed outward (i.e., upward, in the +z-direction) to locate in the position shown in section in FIG. 5*b* and also in FIGS. 2*a*, 2*b* and 2*c*. In the general sense, the periphery of penetration 76 has a shape that conforms to protrusion 68, be it round, oval, elliptical, square, rectangular, or some other shape shared by both of them. They mate closely together to form a water-tight engagement or seal. To that end, protrusion 68 may be generally tapered, from a larger section at its base, or proximal end 78, near root 64, to a smaller section at its distal tip 80. It may have a pyramidal, or generally pyramidal, appearance. At the base of this pyramid there is an inward relief, or groove, or channel, or seat 82 formed in the outside face of protrusion 68. Seat 82 extends peripherally around the outside of protrusion 68 to leave a smaller sized neck 86. The formation of seat 82 yields an abutment, or shoulder 88 that faces rearward, or downward (i.e., in the −z direction) toward root 64. At the same time, matrix 54 has an outwardly upstanding cusp or radius formed around opening 76, as a border or lip 90 of opening 76. Inasmuch as part 62 is made of a relatively softer material, such as a silicone, and matrix 54 is made of a harder, or stiffer material such as a molded rigid thermosetting plastic or metal such as aluminum or stainless steel; and given that the body of protrusion 68 is larger than opening 76, protrusion 68 is compressed or squeezed on installation such that, once shoulder 88 clears lip 90 it expands, and then discourages rearward extraction or disengagement of protrusion 68. In this position, neck 86, which is larger than opening 76, is in an interference fit and remains in slight compression in the hoop-stress direction, in a sealing engagement. Expressed differently, when this engagement occurs, matrix 54, or more specifically the fitting of matrix 54 associated with lip 90, is sandwiched between shoulder 88 and the upper surface of foot or root 64. The outside of the bottom end of protrusion 68 mates flush with the curvature of lip 90, so that the overall assembly has smooth slope continuity. As may also be noted, the outside face of protrusion 68 has a relief or cusp or hollow 92 formed shy of the distal tip 80.

In addition to the first fitting defined by protrusion 68, part 62 also has a second fitting that may be identified as pressure relief port 94. In the embodiment illustrated, in side view, pressure relief port 94 has the general shape of a mushroom, with a stem or neck 96 surmounted by a larger, radially outwardly more extensive head, or cap, 98. A pressure relief port passageway or vent 100 is formed through the middle of the body of cap 98 and neck 96 such that there is fluid communication between the inside of chamber 40.

There is a corresponding second wall penetration or opening 102 formed in matrix 54 of body 50. Opening 102 is sized to be in interference fit with neck 96, to form a seal. That is, opening 102 is slightly smaller than the un-deformed outside diameter of neck 96, so that, as installed, neck 96 is in slight compression. Expressed differently, on installation matrix 54 is sandwiched between the underside of the mushroom head cap and the upper face of root 64.

In use, part 62 is a single piece part that combines both the spout and the pressure relief air vent functions. It forms a seal at both the spout and the pressure relief fitting. When installed, both the expanding shoulder of protrusion 68 and the mushroom cap feature of pressure relief port 94 bias those interfaces to a water-tight sealed condition, and deter unintentional or inadvertent removal. Nonetheless, since part 62 is made of softer, more flexible material, it can be squeezed or otherwise deformed to permit removal, as, for example, when it is desired that they be washed. Furthermore, it may be desirable when re-using assembly after a period of time for part 62 to be replaced with a new part, e.g., for the purpose of sanitation.

In an alternate embodiment, drinking spout 60 and air vent 100 may be formed as separate parts. As shown in FIG. 7*g*, parts 63 and 65 have a separate spout 61 and vent 100, respectively. As can be seen, the two parts are sized and shaped to permit installation without interfering with each other. Whether as a single piece part 62 or as a pair of co-operating parts 63, 65, these members can be removed for cleaning or replacement, as may be suitable.

As noted, container lid assembly 24 also has a spout cover 70. Spout cover 70 is movable between a first position to close spout 60; and a second position in which spout 60 is uncovered, i.e., open, permitting a person to drink from container assembly 20. In the examples, spout cover 70 is movable in a first degree of freedom of motion between those two positions. In the example, that degree of freedom of motion is pivotal motion about an axis of rotation.

Spout cover 70 can be thought of as a beam or lever 110 having a first end 104 and a second end 106. First end 104 may be termed the proximal end, and second end 106 may be termed the distal end. In this example, first end 104 is pivotally mounted to matrix 54, and second end 106 is the distaff, or distal, end that is free to swing. Starting at the pivoting end and extending radially away therefrom, beam 110 has a first portion 112, a second portion 114, a third portion 116 and a fourth portion 118. First portion 112 extends from first end 104 to a mid-way location toward second end 106. First portion 112 has a channel shaped section, having a back 120 and a pair of side webs 122, 124. Back 120 extends laterally to span the space between side webs 122, 124. Axle members in the form of stub axles or trunnions 126 project sideways outwardly from webs 122, 124 respectively. These stub axles or trunnions engage mating sockets 128 formed in matrix 54. The pivoting relationship of spout cover 70 to lid body 50 is established by the rotation of trunnions 124 in sockets 126 about the axis of rotation so defined. Stubs or pimples 127 stand outwardly of webs 122, 124 radially away from trunnions 124 and engage mating detents in the channel sidewalls to form a male-and-female detent relationship to retain lever 110 in the open position.

Forwardly, or radially further away from trunnions 124, spout cover 70 has second portion 114 that has the general form of a plate or tab 130. Tab 130 runs horizontally in a plane. When spout cover 70 is closed, the underside surface of tab 130 engages, and forms a stopper for, vent 100 of pressure relief port 94. Inasmuch as spout cover 70 is made of a harder or stiffer material than is cap 98 of pressure relief port 94, when the two are pressed together the underside of tab 130 forms a seal against cap 98, and obstructs flow.

Between second portion 114 and fourth portion 118, third portion 116 is shaped as a formed hood or cap 132 that stands upwardly of plate or tab 130. The formed hood, or cap, 132 is formed to have an internal cavity 134 that corresponds in size and shape to protrusion 68. That is, it approximates a female cavity, or negative image, of protrusion 68. When spout cover 70 is moved from its open position to its closed position, cap 132 seats over the top of, and obstructs, spout 60. To aid in that obstruction, the inside of cap 132 has a contact surface, or contact pad, or rim, or footprint 136 that stands inwardly proud of the internal surface of cap 132. That contact surface 136 is formed to have the same plan form or footprint as the top end of protrusion 68, such that when cap 132 is closed over protrusion 68, contact surface 136 mates in a slightly compressive, sealing contact with the tip or protrusion 68. It may thereby form a seal that tends to resist leakage of liquid from chamber 40 when container assembly 20 is jostled about, as it may be when hung from a back pack, packed in the car, and so on.

At the radially outside edge of cap 132, fourth portion 118 merges radially outwardly therefrom and has the form of a flange, or extension, or arm, or finger, or wing 140. Wing 140 may also have an upwardly protruding blister or rib or bead 138 along its outer edge. That outer edge has a curvature that corresponds to the curvature of the outer periphery of container lid assembly 24 more generally.

Figure 4C:
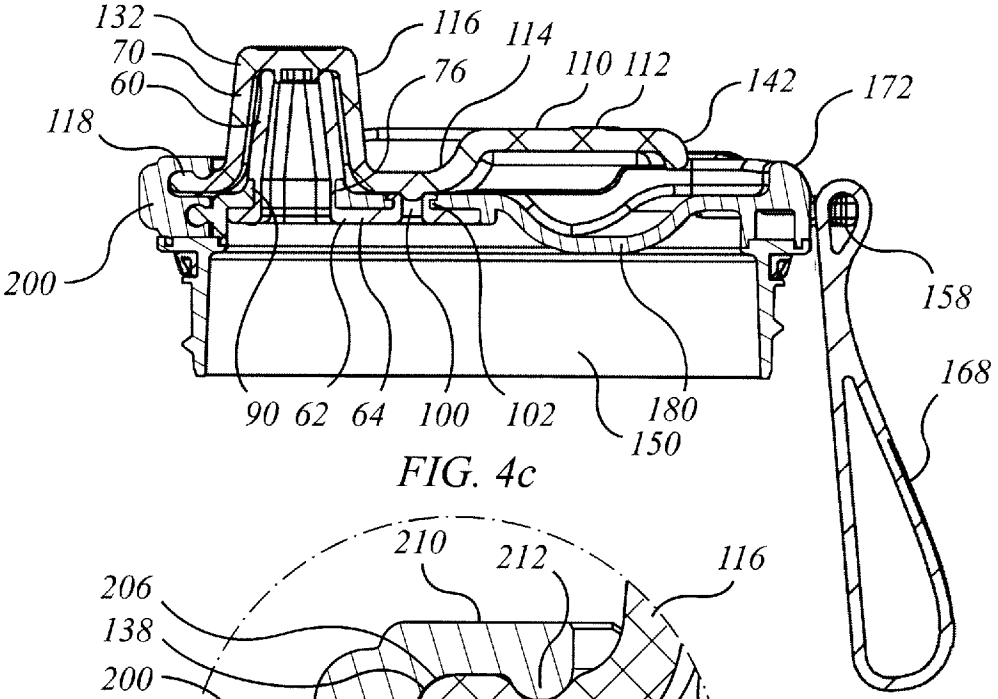
FIG. 4*c* is a sectional view of the container lid assembly of FIG. 4*b* taken on the Center Line section as at '4*c*-4*c*' in FIG. 4*b*, with the spout cover closed.

At the opposite end of beam 110, at first end 104, the rearwardmost edge 142 of first portion 112 is radiused both laterally, on the large curve seen in plan view, and locally, as seen in longitudinal cross-section in FIG. 4*c*. In the middle of beam 110, at the transition between first portion 112 and second portion 114, there is a transversely running wall 144 that joins back 120 to tab 130. Wall 144 may not be in a vertical plane, but may be inclined on an oblique slope from tab 130 to back 120. The combined effect of wall 142, tab 130 and the radially inward wide of hood 132 is to form a stiffened, cross-wise running section. Finally, the side margins of beam 110 have laterally extending blisters, or knobs, or nubbins, or bulges, or pimples, such as may be identified as detents or retainers 146. The margins of beam 110 have been relieved with incisions to either side of retainers 146, such that those retainers have a length, and can deflect slightly out of plane, so that they can flex.

Top panel or matrix 54 is formed to accommodate beam spout cover 70. That is matrix 54 has a circumferentially radially outwardly extending shoulder 152 above downwardly depending skirt 150 upon which fitting 34 is formed. A seal, such as an O-ring 148 seats in the accommodating formed at the corner junction between shoulder 152 and skirt 150. Above shoulder 152 there is an upstanding sidewall 154 and a generally flat, planar, annular web portion 156. Upstanding sidewall and annular web portion 156 merge at a smoothly radiused corner. Along two portions of that smooth radius are peripherally extending ridges, or walls, or fences, or indexing members, identified as retainers 160 and 162 respectively. In the example shown, retainers 160, 162 are formed on the same circumference relative to the center point of lid assembly 24. Also in the example shown, retainer 162 extends along a shorter arc than retainer 160, although the combined arcuate range exceeds 180 degrees. In the embodiment illustrated, the combined arcuate span from the most distant end of retainer 160 to the most distant end of retainer 162 is about the arc from 4 o'clock to 12 o'clock. At the back of container lid assembly 24, matrix 54 has a lug, or hang strap attachment fitting identified as item 158. The hang strap is identified as 168. Radially inward from annular web portion 156 is an out-of-plane protruding portion having first and second parts 164, 166, that would otherwise form a central dome or uplift in top panel or matrix 54.

However, annular web portion 156 does not form a complete annulus, and first and second parts 164, 166 do not form a continuous dome because a relief, or rebate, or accommodation 170 has been formed in the top of lid assembly 24 into which spout cover 70 fits as seen in FIGS. 1*f* and 2*a*-2*e*. In general, when closed and seen in plan form, spout cover 70 has a generally rectangular footprint, and is symmetrical about the radius on which it swings, or, alternatively expressed in the context of this example, is symmetrical about the diameter of container lid assembly 24 that is perpendicular to the pivot axis of spout cover 70. Neither of these conditions need necessarily be true. However, it is convenient for manufacture and for operation for spout 50 and spout cover 70 to lie on, and to be symmetrical relative to, that diameter. To that end, accommodation has been formed in matrix 54 and forms a sunken seat for spout cover 70. As can be seen in top view in FIG. 1*f*, the curvature of rearwardmost edge 142 forms a continuous, or roughly continuous arc with the outside arc of portions 164, 166 when spout cover 70 is closed. As can also be seen, accommodation 170 extends on the diameter almost the entire distance across matrix 54, except for a peripheral lip 172 at the back, i.e., next to strap hanger attachment fitting 158. In effect, accommodation 170 is a channel that is open at the front end, and closed at the back end. It has parallel sidewalls 174, 176 that are spaced apart to accommodate, and bracket, side webs 122, 124. When spout cover 70 is closed, back 120 lies flush, or substantially flush, with the upper surfaces of parts 164 and 166. Pivot axle fittings 184 that engage trunnions 126 are formed in sidewalls 174, 176. That is, pivot axle fittings 184 define sockets formed in matrix 54 that receive trunnions 126. Accommodation 170 has a flat, horizontally extending bottom wall 178 relative to sidewalls 174, 176. That flat bottom wall is interrupted by, i.e., includes, an evacuated cusp, or relief 180 that forms a well underneath the axis of trunnions 126 and fittings 178, that allows the tail of beam 110 to swing as spout cover 70 is moved between open and closed positions. In the embodiment shown, relief 180 has a curve that matches the curved of rearwardmost edge 142. The very bottom of the cusp is under-sized in depth, such that there is a sliding interference fit as the center of rearwardmost edge 142 binds slightly against the under-sized portion of the cusp. The friction is sufficient to permit spout cover 70 to remain in the upright position illustrated in FIG. 2*c*, in effect defining a third or mid-range stop, or rest, position between the first and second positions defined by the closed and fully open positions of spout cover 70 shown in FIGS. 2*e* and 2*a*, respectively. Further indexing fittings, or sockets, or detent fittings are illustrated at 182. These fittings are placed releasably to engage the pimples defined by retainers 146 when spout cover 70 is closed. That is, the pimples tend to snap into, or pop into the sockets defined by fittings 182. When spout cover 70 is opened, the user applies a force to overcome the detent, and open the spout cover.

Figure 1F:
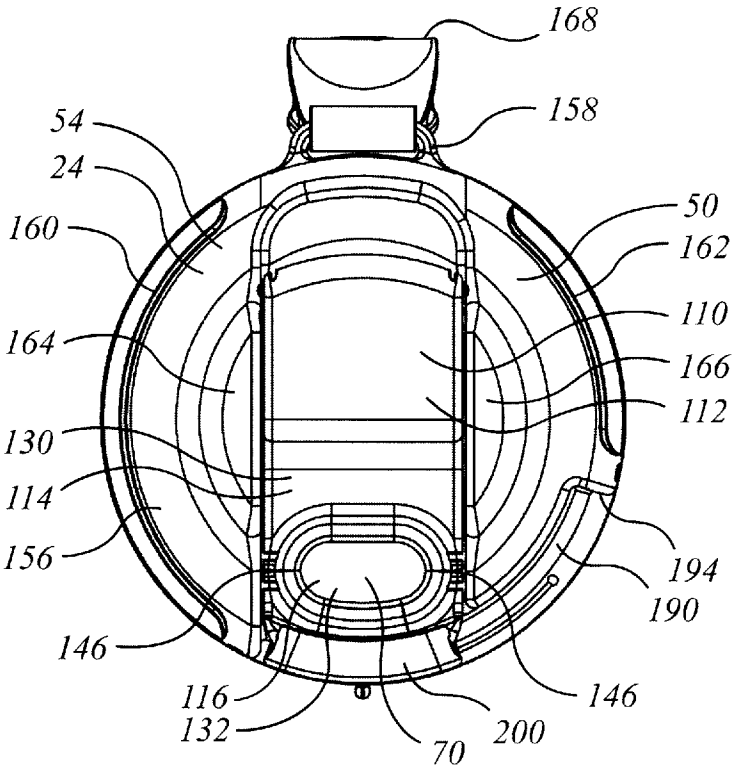
FIG. 1*f* is a top view of the container assembly of FIG. 1*a;*

Top panel or matrix 54 also has a guide or rail identified as trackway 190, and a movable lock, 200. That is to say, sidewall 154 does not extend fully through 360 degrees, but rather is truncated at a first termination, or end of range, identified as abutment 192 at the open and of accommodation 170 and also at a second, circumferentially opposed, termination or end of range somewhat more than twice the subtended arc of second end 106 away in the counter-clockwise direction as seen in FIG. 1*f*, identified as abutment 194. It is arbitrary where this range of motion distance is oriented clockwise or counter-clockwise (i.e., left-handed or right-handed) relative to the spout closure defined by spout cover 70. It may be noted that the example shown in FIG. 1*f* may be operated more easily by the thumb of a right-handed person than a left-handed person, when assembly 20 is held on one hand. This may be more convenient for a person driving a car with a steering wheel on the left, with a cup holder in the central console between front seats of the car.

Figure 4D:
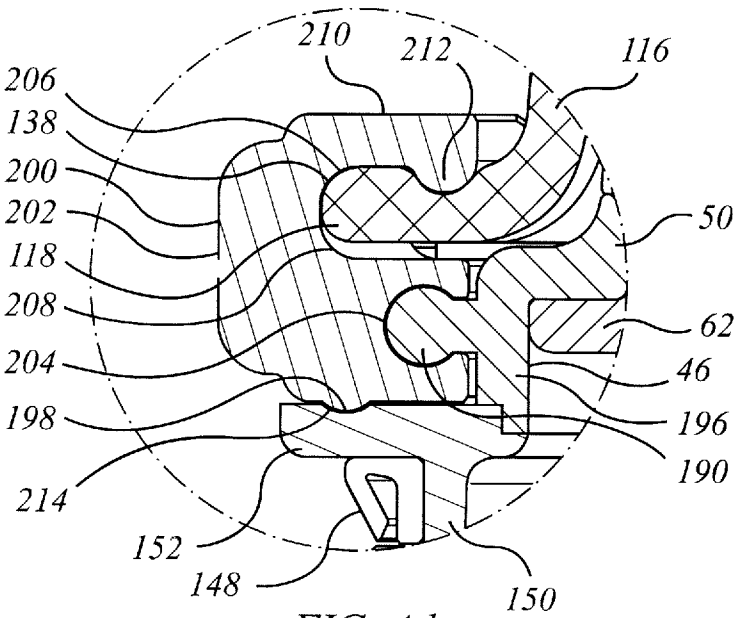
FIG. 4*d* is an enlarged detail of the section of FIG. 4*c;*
Figure 4A:
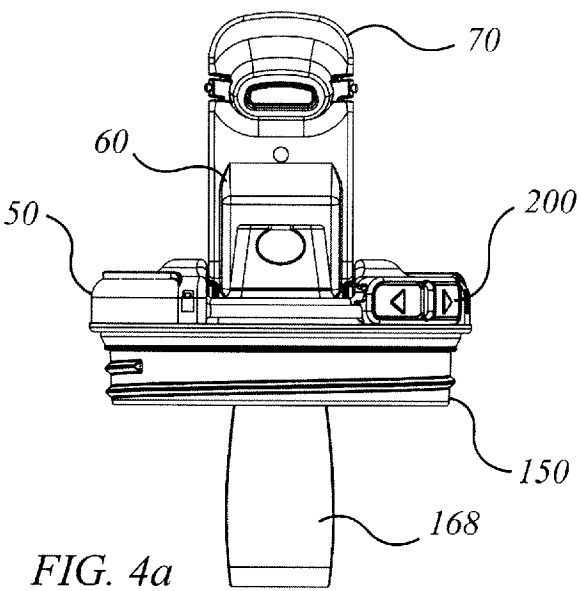
FIG. 4*a* is a front view of the container lid assembly of FIG. 2*c* with the spout cover in an upright orientation and unlocked.
Figure 4B:
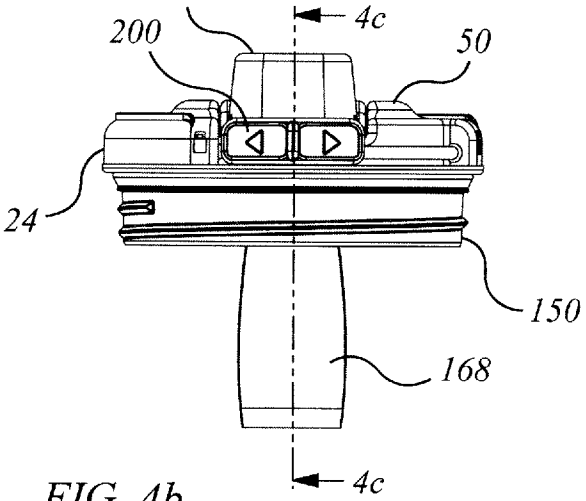
FIG. 4*b* is a front view of the container lid assembly of FIG. 2*e* with the spout cover closed and locked.

In the interruption of sidewall 154 there is a recessed circumferentially extending wall 196. Trackway 190 has the form of a beaded flange, or web. The web extends radially outwardly from wall 196, and the bead runs in the circumferential direction along the radially outermost margin of the web between abutments 192 and 194. It thereby forms a monorail track for the moving member, or car, 202 of lock 200. There is a slight blister on the upper surface of shoulder 152 that extends circumferentially three-quarters of the way from abutment 192 to 194. It is large enough to interfere with the motion of car 202, such that the motion must overcome friction, thereby tending to discourage car 202 from moving as long as it is in contact with blister 198. At the far end of the range (i.e., when car 202 is disengaged, or unlocked) car 202 becomes free of friction from blister 198 just before car 202 encounters abutment 194. Alternatively, blister 198 can be mounted on the underside of car 202, and a corresponding hollow groove 199 can be formed in the upper surface of shoulder 152, as seen in FIG. 4*d*.

Car 202 of lock 200 has the form of a sector of an annulus of a circular arc, with a center of curvature conforming to that of the bead of trackway 190. Car 202 has a first follower 204 and a second follower 206. On the radially outward surface, or back, of lock 200 there is an engagement fitting, or grip in the form of a protruding rib 203 for engagement by, e.g., the user's thumb. First follower 204 has the form of an open-sided slot that conforms to, and follows, the bead of trackway 190. That is, it is a slot of generally circular cross-section formed in the body of car 202 in which the slot is narrowly open on one side, namely the radially inward side, to admit passage of the narrower web of trackway 190, but that captures the larger head or bead, and so car 202 retained on the track. That is, it has a single degree of freedom of motion in translation in the circumferential direction along trackway 190, while being restrained in the axial and radial directions. Second follower 206 is a latch keeper. It has the form of an arcuate slot 208 having a U-shaped cross-section sized and shaped to admit the ridge or ribbed end 108 as at bead 138, as seen in FIG. 4*d*. As seen, the tip of overhanging finger 210 of car 202 has a downwardly depending quasi-flange in the form of a protrusion, or rib, or bead 212 that functions as a guide or follower tending to seat in the corresponding cusp-shaped relief 214 of end 108 behind (i.e., radially inwardly of) bead 138. When car 202 is pushed to its first, or engaged, or closed position, as in FIG. 2*e*, bead 138 is engaged within slot 208, and, as so engaged, car 202 of lock 200 exerts a downward pressure on end 108, tending to cause spout cover 70 to seal both spout 50 and pressure relief vent 100. Since the fit is a friction fit, car 202 will tend to remain in place until a positive force is applied to cause it to move along trackway 190 in the counter-clockwise direction from the first (locked) position to the second (unlocked) position when car 202 moves away from first abutment 192 toward second abutment 194. Thus container lid assembly 24 includes a first member—its body 50, a second member, spout part 62; a third member, spout cover 70, and a fourth member, lock 200. The inter-relationship of the lock 200 in a second degree of freedom, namely circumferential translation, secures spout cover 70 in a locked and sealed position relative to spout part 62. In both case, the reaction to the pressing force is provided by the first member, body 50 that acts that the force, motion, and dimensional datum for the assembly.

Figure 8D:
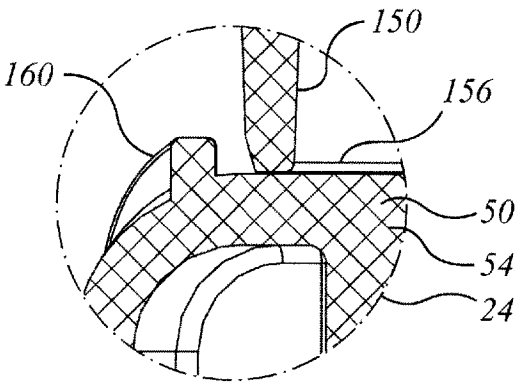
FIG. 8*d* is an enlarged detail of the stacked container lid assemblies of FIG. 8*c;*
Figure 8C:
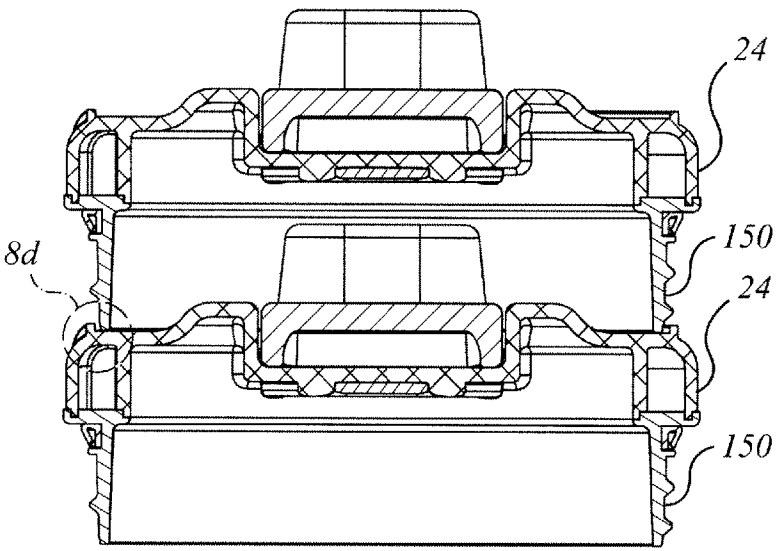
FIG. 8*c* is a section as seen in FIG. 8*a*, of the two container lid assemblies of FIG. 8*b* as stacked.
Figure 8A:
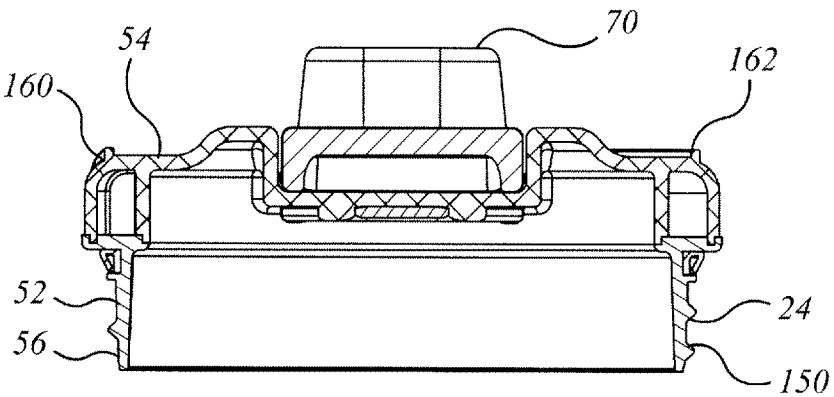
FIG. 8*a* is a diametral section of the container lid assembly of FIGS. 3*c* and 3*d;*
Figure 8B:
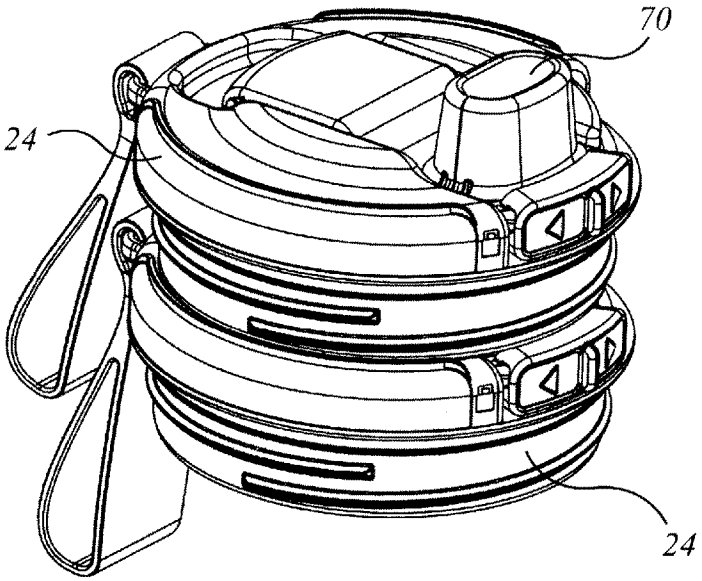
FIG. 8*b* is an isometric view of two container lid assemblies of FIG. 2*e* stacked one upon the other.

In the past, the storage, shipping and packing of cups with spouts has sometimes been an inconvenience. To that end, the various cups are stackable, even when they are not of the same type. Likewise, the container lid assemblies 24 are stackable as seen in FIGS. 8*b* and 8*c*, given that the lowermost margin of skirt 150 seats within, and is radially captured by, the combined effect of the upstanding ridges of retainers 160 and 162 as illustrated in the enlarged detail of FIG. 8*d*. As also seen in FIG. 8*d*, the vertical height of skirt 150 is such that the cavity under matrix 54 provides vertical clearance for spout cover 70 of a second container lid assembly placed underneath the first container lid assembly 24. In FIG. 9*a*, there are four different examples of container body 22, being a small container 220 with a single wall shell having an external, textured silicone sleeve or coating 218; a small insulated container 222 having a double-walled hollow stainless steel structure with an internal vacuum, thereby forming an insulated structure (see FIG. 9*d*); a large container 224 otherwise similar in structure to container 220 having an internal shell with a textured silicone coating 218; and a large container 226 having a single steel wall and an external textured silicone insulation layer 218. In one example, the single walled shell may be of propylene plastic. In another example it may be a different plastic. All of examples 220, 222, 224 and 226 are mutually stacking, in whatever order. Each of them mates with container lid assembly 24, whichever one of them may be used. As may be noted in FIGS. 9*a*-9*d*, each of the examples has a version of body 22 has a sidewall having a lower portion 230, and an upper portion 232. Lower portion 230 is tapered on a first angle, and forms the portion that may typically be held in the palm of a person's hand when drinking. Upper portion forms the upper rim or edge, and extends as a vertical cylinder, or as a conic section of a second angle that is steeper than the first angle, and may be nearly vertical. Upper portion 232 and lower portion 230 meet at a transition 234 that may have the form of an oblique shoulder 236, which may be radiused outwardly and then upwardly in the direction along the surface proceeding from the base to the rim. When the various container bodies are stacked, each successive transition 234 sits on the upper edge 238 of upper portion 232 of the next-lower body, and so on.

A single container lid assembly 24 may be supplied with any one, two or more of container bodies 220, 222, 224 and 226. Alternatively, a full set of four container lid assemblies may be supplied as a kit with a full set of container body assemblies, or they may be mixed and matched as suitable. This resolves the issue of specific body types requiring only one specific lid, which may be problematic where one part of a larger kit is lost or mis-placed. Here, as long as one container lid assembly 24 remains available, any of the container bodies can be used.

In summary, there is a set of mutually nesting hand-held liquid containment drinking vessels. In that set there is at least a first and a second containment vessels in which at least the first containment vessel has different physical properties than at least the second containment vessel. Each of the containment vessels has an engagement fitting operable to engage a mating fitting of a respective lid and to secure said respective lid thereto. The lids of the respective containment vessels are mutually stackable upon each other.

In one versions there are at least first, second and third liquid containment vessels. In the set, the first containment vessel differs from said second containment vessel in at least one of: (a) liquid containment wall structural material; (b) thermal insulation properties; (c) external hand grip configuration; (d) containment volume; and (e) height. In the example described, one of the containment vessels has a stainless steel liquid containment wall and another one has a molded polymer liquid containment wall. As shown and described above, the liquid containment vessels are drinking mugs and the lids provide their closable covers. The lids each have a spout; a releasably securable spout cover; and a lock operable to secure said spout cover in a liquid-tight closed condition. In some cases, each containment vessel may have a lid. In other cases the number of lids may be different, e.g., fewer than, the number of containment vessels.

Various container body and lid combinations have been shown, or described, or both. The features of the various embodiments may be mixed and matched as may be appropriate without the need for further description of all possible variations, combinations, and permutations of those features.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by the appended claims.

We claim:

1. A container lid assembly comprising:

a first member, a second member, a third member and a fourth member;

said first member defining a body of said lid assembly;

said second member defining a spout of said lid assembly;

said third member defining a spout cover of said lid assembly;

said fourth member defining a lock of said lid assembly;

said body having an interface by which said lid assembly mounts to a container;

said spout defining a passage through said body permitting the passage of liquid therethrough;

said spout cover being pivotally movable relative to said body of said lid assembly between a first position and a second position;

said first position of said spout cover being an open position relative to said spout;

said second position of said spout cover being a closed position relative to said spout;

said lock being mounted to said body of said lid assembly;

said lock being movable between an engaged position and a disengaged position;

in said disengaged position of said lock, said spout cover being movable out of said second position;

in said engaged position of said lock, (a) said spout cover being captured by said lock in said closed position; and (b) said spout cover being forced by said lock to form a liquid tight seal against said spout;

said body has a periphery and said spout is located eccentrically and inwardly relative to said periphery;

said spout has a tip that extends axially outwardly relative to said body;

said spout cover has a pivot axis about which said pivot has a first degree of freedom of angular motion; and said lock being movable in a second degree of freedom that is different from said first degree of freedom such that motion of said lock is cross-wise relative to motion of said spout cover.

2. The drinking container lid assembly of claim 1 wherein said spout is made from a different material than said body, said body being made of a plastic that is more rigid than said spout.

3. The drinking container lid assembly of claim 1 wherein said spout is made from a different material than said body, said body being made of a plastic that is more rigid than said spout; and said assembly has a pressure relief port, and, in said closed position of said spout cover, said pressure relief port is closed by said spout cover.

4. The drinking container lid assembly of claim 3 wherein said spout has a root mounted to said body, and said root includes said pressure relief port.

5. The drinking container lid assembly of claim 3 wherein said pressure relief port is formed in a separate member from said spout.

6. The drinking container lid assembly of claim 1 wherein said body has a depending peripheral skirt, and an upwardly facing peripheral seat, said skirt being sized matingly to engage said peripheral seat, whereby a first said container lid assembly is stackable on top of a second said container lid assembly, and when so stacked, said skirt of said first container lid assembly and said peripheral seat of said second container lid assembly are mutually engaging.

7. The drinking container lid assembly of claim 1 wherein said lock is slidingly movable.

8. The drinking container lid assembly of claim 7 wherein said spout has a tip that extends axially outwardly relative to said body; said spout cover has a protrusion located more distantly from said pivot axis than is said spout; said body includes a guideway; said lock includes a car constrained to follow said guideway; in said engaged position of said lock said car captures said protrusion; and capture of said protrusion by said car presses said cover against said tip to seal said spout.

9. A container lid assembly comprising:

a first member, a second member, a third member and a fourth member;

said first member defining a body of said lid assembly;

said second member defining a spout of said lid assembly;

said third member defining a spout cover of said lid assembly;

said fourth member defining a lock of said lid assembly;

said body having an interface by which said lid assembly mounts to a container;

said spout defining a passage through said body permitting the passage of liquid therethrough;

said spout cover being pivotally movable relative to said body of said lid assembly between a first position and a second position;

said first position of said spout cover being an open position relative to said spout;

said second position of said spout cover being a closed position relative to said spout;

said lock being mounted to said body of said lid assembly;

said lock being movable between an engaged position and a disengaged position;

in said disengaged position of said lock, said spout cover being movable out of said second position;

in said engaged position of said lock, (a) said spout cover being captured by said lock in said closed position; and (b) said spout cover being forced by said lock to form a liquid-tight seal against said spout;

said body includes a guideway;

said lock includes a car constrained to follow said guideway;

said guideway runs adjacent to said periphery; and motion of said car includes travel along a portion of said periphery.

10. The drinking container lid assembly of claim 9 wherein said periphery of said body is circular, and said car moves circumferentially along said periphery between said engaged and disengaged positions thereof.

11. The drinking container lid assembly of claim 1 wherein said spout is made of silicone, and said body is made of a harder material than said spout.

12. The drinking container lid assembly of claim 1 wherein said container lid assembly mates with a liquid container vessel, said body has a depending peripheral skirt, said depending peripheral skirt is threaded and is releasably engageable with a mating threaded margin of the liquid container vessel.

13. A method of operation of the drinking container lid assembly of claim 1 as mounted to a mating container wherein said method includes holding the container and lid assembly in one hand, and moving the lock with a thumb of that hand.

14. A method of operation of the drinking container lid assembly of claim 1 as mounted to a mating container wherein said method includes moving the lock to the engaged position, and, by moving the lock to the engaged position both (a) securing the spout cover over the spout and (b) pressing the spout cover against the spout to seal the spout.

15. The method of operation of claim 14, the drinking container lid assembly having a pressure relief, wherein the moving the lock to the engaged position includes closing the pressure relief as well as sealing the spout.

16. The drinking container lid assembly of claim 9 wherein said spout is made from a different material than said body, said body being made of a plastic that is more rigid than said spout.

17. The drinking container lid assembly of claim 9 wherein said spout is made from a different material than said body, said body being made of a plastic that is more rigid than said spout; and said assembly has a pressure relief port, and, in said closed position of said spout cover, said pressure relief port is closed by said spout cover.

18. The drinking container lid assembly of claim 17 wherein said spout has a root mounted to said body, and said root includes said pressure relief port.

19. The drinking container lid assembly of claim 17 wherein said pressure relief port is formed in a separate member from said spout.

20. The drinking container lid assembly of claim 9 wherein said body has a depending peripheral skirt, and an upwardly facing peripheral seat, said skirt being sized matingly to engage said peripheral seat, whereby a first said container lid assembly is stackable on top of a second said container lid assembly, and when so stacked, said skirt of said first container lid assembly and said peripheral seat of said second container lid assembly are mutually engaging.

21. The drinking container lid assembly of claim 9 wherein said lock is slidingly movable.

22. The drinking container lid assembly of claim 21 wherein said spout has a tip that extends axially outwardly relative to said body; said spout cover has a pivot axis; said spout cover has a protrusion located more distantly from said pivot axis than is said spout; said body includes a guideway; said lock includes a car constrained to follow said guideway; in said engaged position of said lock said car captures said protrusion; and capture of said protrusion by said car presses said cover against said tip to seal said spout.

23. The drinking container lid assembly of claim 9 wherein said spout is made of silicone, and said body is made of a harder material than said spout.

24. The drinking container lid assembly of claim 9 wherein said container lid assembly mates with a liquid container vessel, said body has a depending peripheral skirt, said depending peripheral skirt is threaded and is releasably engageable with a mating threaded margin of the liquid container vessel.

* * * * *